US005242787A

United States Patent [19]

Yasuda et al.

[11] Patent Number: 5,242,787

[45] Date of Patent: Sep. 7, 1993

[54] SILVER HALIDE PHOTOGRAPHIC PHOTOSENSITIVE MATERIALS

[75] Inventors: Tomokazu Yasuda; Shunichi Aida, both of Kanagawa, Japan

[73] Assignee: Fuji Photo Film Co., Ltd., Kanagawa, Japan

[21] Appl. No.: 783,337

[22] Filed: Oct. 28, 1991

[30] Foreign Application Priority Data

Nov. 8, 1990 [JP] Japan ..... 2-303169

[51] Int. Cl.[5] ..... G03C 1/76

[52] U.S. Cl. ..... 430/531; 430/523; 430/627; 430/950

[58] Field of Search ..... 430/531, 627, 523, 950

[56] References Cited

U.S. PATENT DOCUMENTS 4,857,443 8/1989 Aono et al. ..... 430/531
5,057,407 10/1991 Okamura et al. ..... 430/531
5,153,115 10/1992 Yasunami et al. ..... 430/531

*Primary Examiner*—Jack P. Brammer
*Attorney, Agent, or Firm*—Sughrue, Mion, Zinn, Macpeak & Seas

[57] ABSTRACT

Disclosed is silver halide photographic photosensitive material comprising a support, having thereon at least one silver halide photosensitive emulsion layer, wherein a polymer which can be represented by the following general formula (I) is included in at least one of the structural layers of the photographic photosensitive material:

(I)

The term A represents a repeating unit obtained by polymerizing a monomer which has at least two polymerizable ethylenically unsaturated groups of which at least one is in a side chain; B represents a repeating monomer unit obtained by the polymerization of a monomer which has one polymerizable ethylenically unsaturated group; $R^1$ represents a hydrogen atom or an alkyl group; $R^2$ and $R^3$ each represents a hydrogen atom or a methyl group; $R^4$ represents a hydrogen atom or an organic group; $L_1$ represents a divalent group comprising at least three atoms by which the main macromolecular chain and the poly(ethylene oxide) unit are linked; m represents an integer of at least 10, and x, y and z indicate percentages by weight wherein x is from 0 to 30, y is from 0 to 95 and z is from 5 to 100, based on the total weight of the polymer.

3 Claims, No Drawings

SILVER HALIDE PHOTOGRAPHIC PHOTOSENSITIVE MATERIALS

FIELD OF THE INVENTION

This invention concerns silver halide photographic photosensitive materials which contain novel development accelerators. More precisely, the invention concerns silver halide photographic photosensitive materials which contain novel development accelerators which have excellent diffusion resisting properties and which have little action on the silver halide grains.

BACKGROUND OF THE INVENTION

It is known that polyethylene oxides and other polyalkylene oxides (referred to collectively hereinafter as "polyethylene oxide") have a sensitizing effect when they are added to silver halide photographic photosensitive materials, for instance U.S. Pat. Nos. 2,716,062 and 2,784,091 and the literature references cited therein. It is stated in those disclosures that a sensitizing effect is seen from adding polyethylen, oxide derivatives of a molecular weight at least 300 silver halide photographic photosensitive materials.

This property of polyethylene oxide has bee considerable interest to photographic technologists, and many reports have been published in connection with this subject. Much of this research has been summarized on pages 424–426 of *The Theory of the Photographic Process*, fourth edition, edited by T. H. James, published by Macmillan, 1977. According to this work, the sensitizing effect of polyethylene oxides is thought to be a development accelerating action since in a series of developments with different development times the maximum attainable speed is unchanged but the development time for obtaining the highest attainable speed becomes shorter. Moreover, in connection with the development accelerating effect of polyethylene oxides it has been pointed out by Van Veelan et al. and by Kumai's research group that the development accelerating effect is enhanced by the presence of bromide ion. At least the three explanations indicated below have been put forward as to the cause of this effect, but no clear conclusions have been reached:

(i) the polyethylene oxide molecules are adsorbed on the silver halide grains and have an effect of material transfer in the vicinity of the silver halide grains, such as the transfer of the developing agent or the development inhibiting substances which is formed as a result of development;

(ii) the hydrophilicity of a gelatin layer in which polyethylene oxide molecules are adsorbed on the silver halide grains is raised; and (iii) the polyethylene oxide molecules associate with the bromide ions in solution.

On the other hand, the inventors have discovered on investigating the applicability of the aforementioned development accelerating effect due to polyethylene oxide to silver halide multi-layer color photographic photosensitive materials that there are problems such as those indicated below:

(a) polyethylene oxide is highly water soluble and so if the acceleration of development in a specified layer among a plurality of silver halide emulsion layers is to be carried out, diffusion into other layers takes place and there is inevitably a marked effect in the silver halide emulsion layers other than the intended layer. The effect of the polyethylene oxide on each silver halide emulsion layer varies according to the grain size and halogen composition of the silver halide emulsion in each layer, differences in the adsorbed materials such as spectrally sensitizing dyes in each layer and the extent of chemical sensitization of each layer. Consequently, very complicated techniques are required to obtain the desired effect by the addition of polyethylene oxide; and (b) if the molecular weight is increased in order to lower the hydrophilicity of the polyethylene oxide, its adsorption on silver halide grains is increased. This has an adverse effect on the state of adsorption of spectrally sensitizing dyes etc. on the silver halide grains and, depending on the particular conditions, it can lead to aggregation of the silver halide grains or colloidal silver grains.

The inclusion of polyethylene oxide as a partial structure in polymer particles, such as latex particles for example, in order to prevent diffusion in silver halide multi-layer color photographic photosensitive materials has been considered as one means of resolving these problems. On carrying out an investigation in connection with this objective the findings indicated below have now been discovered in connection with the use of latexes which have a polyethylene oxide chain as a partial structure in a silver halide photographic photosensitive material. Thus, it is disclosed in JP-B No. 1-18408 that the film properties such as dimensional stability for example and the anti-static effect can be improved by adding a latex which contains polyethylene oxide chains to a photosensitive material. (The term "JP-B" as used herein means an "examined Japanese patent publication".) It is disclosed in JP-A No. 61-62031 that the covering power of a silver halide emulsion can be improved by means of a latex which contains polyethylene oxide chains. (The term "JP-A" as used herein means an "unexamined published Japanese patent application".) The covering power according to that specification is defined as the value obtained by dividing the optical density by the number of grams of developed silver per unit area and this is not directly related to the development accelerating effect due to polyethylene oxide mentioned earlier.

Inventions in which latexes which contain polyethylene oxide chains are used as media in which hydrophobic substances such as various dye forming couplers are dispersed in silver halide photographic photosensitive materials have been disclosed in JP-B No. 64-3250 and JP-A No. 64-052136. In spite of the wide investigation, there is virtually no disclosure in these specifications of development accelerating effects with latexes which contain polyethylene oxide chains. The polyethylene oxide chains in the latex particles are adsorbed rather weakly on silver halide grains when compared with normal polyethylene oxide, and so the possibility that they have no development accelerating effect cannot be denied.

Thus, when the inventors started their investigation of methods of capturing iodide ions in a silver halide multi-layer color photographic photosensitive materials in a specified layer of the said photosensitive material, it was not clear whether polyethylene oxide was essentially effective for capturing iodide ions. Moreover, it was not clear at all that it would exhibit a development accelerating effect in cases where the polyethylene oxide was included as part of the structure of a macromolecular polymer which was essentially insoluble in water for fixing the polyethylene oxide in a specified layer in a silver halide multilayer color photographic photosensitive material.

As a result of a detailed investigation in connection with this objective, the inventors had shown that the acceleration of development in a specified layer among a plurality of silver halide emulsion layers was possible and that the effect on the photographic speed of the other layers was slight immediately after the manufacture of a photosensitive material when a latex which contained polyethylene oxide chains, as disclosed in JP-B No. 1-18408 for example, was used. However, it was also shown at the same time that this technique was unsuitable for use in photographic photosensitive materials because there was an effect on the photographic performance of the silver halide emulsion layers other than the target layer when the photographic material had been stored and aged.

The above mentioned problem was especially pronounced when the latex which contained polyethylene oxide chains was used in large quantities with a view to greater regulation of development acceleration. Consequently, the development of a latex which contains polyethylene oxide chains for photographic speed adjustment purposes with which there is essentially no change in photographic speed of the other layers even after ageing and storage is clearly desirable.

SUMMARY OF THE INVENTION

One object of this invention is to provide development accelerators which have a development controlling action in a specified layer and little effect on the silver halide grains.

A second object of the invention is to provide development accelerators with which there is little change in the photographic performance of other layers after ageing.

As a result of thorough investigation, the inventors have discovered that these and other objects can be realized in the way described below.

Thus it was discovered that the above mentioned objects could be realized by using a macromolecular polymer comprised of repeating units derived from monomers which have poly(ethylene oxide) structural parts and hydrophobic structural parts in at least one of the structural layers of a photographic photosensitive material comprising a support, having thereon at least one silver halide photosensitive emulsion layer. Moreover, it was found that a high level of success in achieving the above mentioned objects could be attained by copolymerizing crosslinking monomers and/or hydrophobic monomers in these high macromolecular polymers.

These methods are indicated more particularly below.

(1) A silver halide photographic photosensitive material comprising a support, having thereon at least one silver halide photosensitive emulsion layer, wherein a polymer which can be represented by general formula (I) shown below is included in at least one of the structural layers of the photographic photosensitive material:

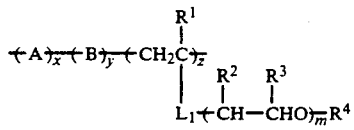

(I)

In this formula, A represents a repeating unit obtained by polymerizing a monomer which has at least two polymerizable ethylenically unsaturated groups of which at least one is included in a side chain. B represents a repeating monomer unit obtained by the polymerization of a monomer which has one polymerizable ethylenically unsaturated group. $R^1$ represents a hydrogen atom or an alkyl group. $R^2$ and $R^3$ each represents a hydrogen atom or a methyl group. $R^4$ represents a hydrogen atom or an organic group. $L_1$ represents a divalent group comprising at least three atoms by which the main macromolecular chain and the poly(ethylene oxide) unit are linked. Finally, m represents an integer of at least 10, and x, y and z indicate percentages by weight wherein x is from 0 to 30, y is from 0 to 95 and z is from 5 to 100, based on the total weight of the polymer.

(2) A silver halide photographic photosensitive material comprising a support, having thereon at least one silver halide photosensitive emulsion layer, wherein a polyurethane compound obtained by reacting dialcohol (C), polyethylene glycol (D) and diisocyanate (E) is included in at least one of the structural layers of the photographic photosensitive material.

(3) A silver halide photographic photosensitive material comprising a support, having thereon at least one silver halide photosensitive emulsion layer, wherein a polyester compound obtained by reacting dialcohol (C), polyethylene glycol (D) and dicarboxylic acid or derivative thereof (F) is included in at least one of the structural layers of the photographic photosensitive material.

DETAILED DESCRIPTION OF THE INVENTION

Examples of preferred monomers for A in general formula (I) include divinylbenzene, ethyleneglycol dimethacrylate, diethyleneglycol dimethacrylate, triethyleneglycol dimethacrylate, ethyleneglycol diacrylate, diethyleneglycol diacrylate, 1,6-hexanediol diacrylate, neopentylglycol dimethacrylate, tetramethyleneglycol dimethacrylate and methylenebisacrylamide, and of these divinylbenzene, and ethyleneglycol dimethacrylate are especially desirable. A may be a repeating unit obtained by using a mixture of two or more of the above mentioned monomers.

Examples of monomers which give repeating units which are preferred for B include mono-ethylenically unsaturated hydrocarbons (for example, ethylene, propylene, 1-butene, isobutene, styrene, α-methylstyrene, vinyltoluene), mono-ethylenically unsaturated esters of aliphatic acids (for example, vinyl acetate, allyl acetate), ethylenically unsaturated mono-carboxylic acid or dicarboxylic acid esters (for example, methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate, 2-chloroethyl acrylate, 2-hydroxyethyl acrylate, maleic acid di-butyl ester, maleic acid mono-octyl ester, itaconic acid di-methyl ester), ethylenically unsaturated mononcarboxylic acid or dicarboxylic acid amides (for example, acrylamide, methacrylamide, N-methylacrylamide, N,N-dimethylacrylamide, N-ethylacrylamide, N-isopropylacrylamide, N-tert-butylacrylamide, N,N-dihexylacrylamide, N-methylolacrylamide, N-acryloylmorpholine, N-acryloylpiperidine, diacetoacrylamide, N-(N',N'-dimethylaminoethyl)acrylamide, sodium 2-acrylamido-2-methylpropanesulfonate and compounds represented by $CH_2{=}CH{-}CONH{-}(CH_2)_8COOH$), monoethylenically unsaturated mono-carboxylic acids or dicarboxylic acids and their salts (for example, acrylic acid, sodium acrylate, methacrylic acid, potassium methacrylate, itaconic acid, maleic acid), mono-ethylenically unsaturated compounds (for example acrylonitrile, methacrylonitrile, vinylidene chloride, vinyl chloride, α-chloromethylstyrene, p-chloromethylstyrene, m-hydroxymethylstyrene) and dienes (for example butadiene, isoprene). Among these, styrene, esters of monoethylenically unsaturated mono-carboxylic acids (for example methyl methacrylate, n-butyl methacrylate, benzyl methacrylate), mono-ethylenically unsaturated mono-carboxylic acid amides (for example N-tert-butylacrylamide, N,N-dibutylacrylamide), acrylonitrile and chloromethylstyrene, for example, are especially desirable. B may be a repeating unit obtained by using a mixture of two or more of the above mentioned monomers.

$R^1$ is preferably a hydrogen atom or a lower alkyl group which has from 1 to 6 carbon atoms (for example methyl, ethyl, n-propyl, n-butyl, n-hexyl, isopropyl). Among these, the hydrogen atom and the methyl group are the most desirable. $R^2$ and $R^3$ each represents a hydrogen atom or a methyl group, and at least one of $R^2$ and $R^3$ preferably represents a hydrogen atom. Most desirably both $R^2$ and $R^3$ represent hydrogen atoms. $R^4$ preferably represents a hydrogen atom, a substituted or unsubstituted alkyl group which has from 1 to 25 carbon atoms (for example methyl, ethyl, isopropyl, n-hexyl, n-dodecyl, benzyl, 2-cyanoethyl, 2-chloroethyl, 3-methoxypropyl, 4-phenoxybutyl, 2-carboxyethyl, $-CH_2CH_2SO_3Na$, $-CH_2CH_2NHSO_3CH_3$), a substituted or unsubstituted aryl group which has from 6 to 25 carbon atoms (for example phenyl, p-methylphenyl, p-methoxyphenyl, o-chlorophenyl, p-octylphenyl, p-dodecylphenyl, naphthyl), an acyl group (for example, acetyl, propionyl, benzoyl, octanoyl), a carbamoyl group (for example, $-CONHCH_3$,

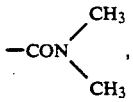

$-CONHC_6H_{13}$). Most desirably $R^4$ represents a hydrogen atom, a methyl group, an ethyl group, a phenyl group or an acetyl group. Furthermore, $R^4$ is preferably a photographically useful group, and most desirably an organic group which controls development (for example, a thioalkyl ether group or a thiocarbamato group).

$L_1$ represents a divalent linking group which preferably has at least three carbon atoms, and it is most desirably a group which can be represented by general formula (II) or general formula (III) indicated below.

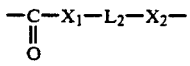

(II)

In this formula, $X_1$ represents an oxygen atom or

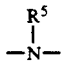

wherein $R^5$ is a hydrogen atom, a substituted or unsubstituted alkyl group, a substituted or unsubstituted aryl group, a substituted or unsubstituted acyl group or a group which can be represented by

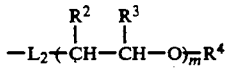

(wherein $R^2$, $R^3$, $R^4$ and m have the same means as described earlier), and it is preferably a hydrogen atom, a substituted or unsubstituted alkyl group which has from 1 to 10 carbon atoms (for example methyl, ethyl, n-butyl, n-octyl),

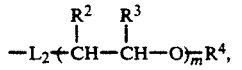

or an acyl group, (for example acetyl, propanoyl, benzoyl, and it is more desirably a methyl group, an acetyl group or

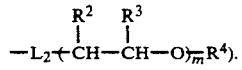

Most desirably of all, $X_1$ is an oxygen atom or an —NH— group.

$L_2$ is a substituted or unsubstituted alkylene group which has at least 2 but not more than 20 carbon atoms in its main chain (for example,

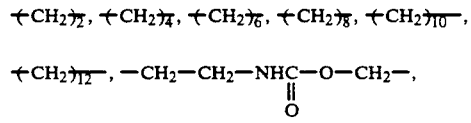

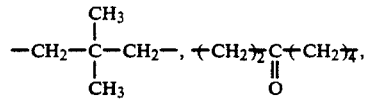

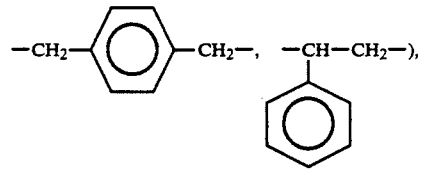

or a substituted or unsubstituted arylene group which has at least 6 carbon atoms (for example

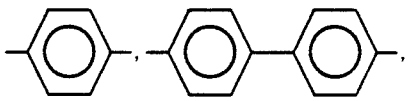

-continued

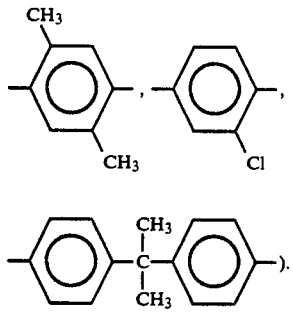

Most desirably $L_2$ is a $(CH_2)_n$ group (wherein n represents an integer of at least 4 and not more than 12).

$X_2$ preferably represents an oxygen atom,

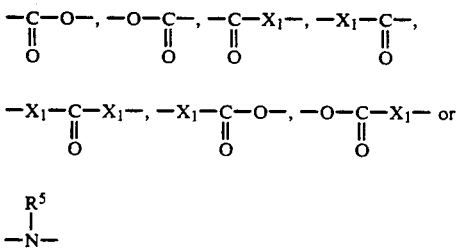

(wherein $X_1$ and $R^5$ have the same meaning as described earlier), and of these the oxygen atom,

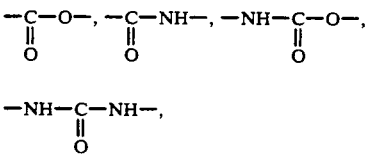

and

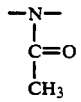

are especially desirable.

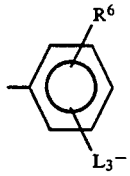

(III)

In this formula $R^6$ represents a hydrogen atom, a halogen atom or a substituted or unsubstituted alkyl group or an acyl group, and it is preferably a hydrogen atom, a chlorine atom, a lower alkyl group which has not more than 6 carbon atoms or a lower acyl group. Most desirably it is a hydrogen atom or a methyl group. $L_3$ is a bond, $—L_2—$, $—X_2—$, $—L_2—X2—$, $—X_1—L_2—X_2—$ or

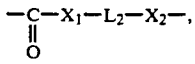

and it is preferably $—L_2—$, $—X_2—$ or $—L_2—X_2—$. It is most desirably $—CH_2—O—$, —COO—, —CONH— or —O— for example. The terms $X_1$, $X_2$ and $L_2$ are as defined above.

Moreover, m is preferably at least 13 but not more than 100, and most desirably at least 15 but not more than 50.

Moreover, x is preferably a percentage from 5 to 25, and most desirably of from 10 to 20, y is preferably a percentage from 10 to 80, and most desirably of from 30 to 70, and z is preferably a percentage from 15 to 85, and most desirably of from 20 to 50.

The dialcohol (C) with which the polyurethane compounds and/or polyester compounds of this invention are formed is preferably a dialcohol which can be represented by the general formula (IV) indicated below.

$$HO—R^7—OH \quad (IV)$$

In this formula, $R^7$ represents an alkylene group (including substituted alkylene groups) which has at least 4 but not more than 30 carbon atoms or an aralkylene group (including substituted aralkylene groups) which has 7 to 36 carbon atoms. No particular limitation is imposed upon the substituent groups of the alkylene and aralkylene groups of $R^7$, but preferred examples of the substituent groups include halogen atoms (for example, fluorine, chlorine, bromine), a cyano group, alkoxy groups (for example, methoxy, ethoxy, benzyloxy), aryloxy groups (for example, phenoxy), a nitro group, an amino group, a carboxyl group, alkyloxycarbonyl groups (for example, methoxycarbonyl, propoxycarbonyl), acyl groups (for example, acetyl, benzoyl), alkylcarbamoyl groups (for example, dimethylcarbamoyl), acylamino groups (for example, acetylamino) and a sulfonyl group.

Preferred examples of the organic diols of this type include ethylene glycol, trimethylene glycol, propylene glycol, tetramethylene glycol, hexamethylene glycol, butylene glycol, neopentyl glycol, 2,5-hexanediol, 1,4-cyclohexanediol, 1,4-cyclohexanedimethanol, diethylene glycol, 1,12-dodecanediol, polypropylene glycol, 1,4-benzenedimethanol, 1,3-benzenedimethanol, 1,4-benzenediethanol and 1,4-naphthalenedimethanol. From among these tetramethylene glycol, hexamethylene glycol, 1,4-cyclohexanedimethanol, 1,4-benzenedimethanol and 1,12-dodecanediol are especially desirable. Any two or more of these diols can be used in the form of a mixture.

No particular limitation is imposed upon the preferred polyethylene glycol (D) from which the polyurethane compounds of this invention are constituted and those of any molecular weight can be used. But those of an average molecular weight not more than 5000 are preferred and those of an average molecular weight at least 600 but not more than 2000 are especially desirable. The use of modified polyethylene glycols (for example, poly(ethylene oxide-co-propylene oxide), poly(ethylene oxide-co-butylene oxide), poly(ethylene oxide-co-$\beta$-propiolactone) and poly(ethylene oxide-co-$\epsilon$-capro-lactam) is also desirable. In this case there is no especially preferred range for the molecular weight.

Any two or more of these polyethylene glycols can be used in the form of a mixture.

The diisocyanate (E) from which the polyurethane compounds of this invention are constituted is preferably a diisocyanate which can be represented by general formula (V) which is shown below.

$$O{=}C{=}N{-}R^8{-}N{=}C{=}O \qquad (V)$$

In this formula, $R^8$ represents an alkylene group (including substituted alkylene groups) which has at least 4 but not more than 30 carbon atoms, or an aralkylene group (including substituted aralkylene groups) which has 7 to 36 carbon atoms. No particular limitation is imposed upon the substituent groups of the alkylene groups or aralkylene groups represented by $R^8$, but preferred substituent examples include halogen atoms (fluorine, chlorine, bromine), a cyano group, alkoxy groups (for example, methoxy, ethoxy, benzyloxy), aryloxy groups (for example, phenoxy), a nitro group, alkyloxycarbonyl groups (for example, methoxycarbonyl, propoxycarbonyl), acyl groups (for example, acetyl, benzoyl), alkylcarbamoyl groups (for example, dimethylcarbamoyl), acylamino groups (for example, acetylamino) and a sulfonyl group.

Preferred examples of the diisocyanates of this type include methylenediisocyanate, ethylenediisocyanate, isophoronediisocyanate, hexamethylenediisocyanate, 1,4-cyclohexyldiisocyanate, 2,4-toluenediisocyanate, 2,6-toluenediisocyanate, 1,3-xylylenediisocyanate, 1,4-xylylenediisocyanate, 1,5-naphthalenediisocyanate, m-phenylenediisocyanate, p-phenylenediiso-3,3'-dimethylbiphenylenediisocyanate, 4,4'-biphenyleneisocyanate, dicyclohexylmethanediisocyanate and methylenebis(4-cyclohexylisocyanate). Any two or more of these diisocyanates can be used in the form of a mixture.

The dicarboxylic acid or derivative thereof (F) from which the polyester compounds of this invention are constituted is preferably a dicarboxylic acid or derivative thereof which can be represented by general formula (VI) which is indicated below.

$$Q{-}\underset{\underset{O}{\|}}{C}{-}R^9{-}\underset{\underset{O}{\|}}{C}{-}Q \qquad (VI)$$

In this formula, $R^9$ represents an alkylene group (including substituted alkylene groups) which has at least 4 but not more than 30 carbon atoms, or an aralkylene group (including substituted aralkylene groups) which has 7 to 36 carbon atoms. No particular limitation is imposed upon the substituent groups for the alkylene groups or aralkylene groups of $R^9$, but preferred substituent groups include halogen atoms (fluorine, chlorine, bromine), a cyano group, alkoxy groups (for example, methoxy, ethoxy, benzyloxy), aryloxy groups (for example, phenoxy), a nitro group, alkyloxycarbonyl groups (for example, methoxycarbonyl, propoxycarbonyl), acyl groups (for example, acetyl, benzoyl), alkylcarbamoyl groups (for example, dimethylcarbamoyl), acylamino groups (for example, acetylamino) and a sulfonyl group.

Q represents a group which can be eliminated. A hydroxyl group, a methoxy group and a chlorine atom are especially desirable examples of Q.

Examples of the dicarboxylic acids and derivatives thereof which can be used in this invention include oxalic acid, malonic acid, succinic acid, glutaric acid, dimethylmalonic acid, adipic acid, pimelic acid, α,α-dimethylsuccinic acid, acetonedicarboxylic acid, sebacic acid, 1,9-nonanedicarboxylic acid, 1,12-dodecanedicarboxylic acid, 1,10-decanedicarboxylic acid, fumaric acid, maleic acid, itaconic acid, citraconic acid, phthalic acid, isophthalic acid, terephthalic acid, 2-butylterephthalic acid, tetrachloroterephthalic acid, acetylenedicarboxylic acid, poly(ethylene terephthalate)dicarboxylic acid, 1,2-cyclohexanedicarboxylic acid, 1,4-cyclohexanedicarboxylic acid, ω-poly(ethylene oxide)dicarboxylic acid, p-xylylenedicarboxylic acid, and the dimethyl esters of the above mentioned dicarboxylic acids and the above mentioned dicarboxylic acid chlorides. Two or more of the above mentioned dicarboxylic acids and derivatives thereof may be used in the form of a mixture.

The mixing ratio of the diol (C) and the polyethylene glycol (D) from which the polyester compounds and polyurethane compounds of this invention are constituted can have any value, but the range of from 20 wt % to 90 wt % of polyethylene glycol is desirable from the viewpoint of the iodine ion trapping capacity and the viewpoint of resistance to diffusion. The range of from 40 wt % to 80 wt % of polyethylene glycol is especially desirable.

The mixing ratio of the diol (C), the polyethylene glycol (D) and the diisocyanate (E) from which the polyurethane compounds of this invention are constituted can have any value, but the range of from 30 wt % to 75 wt %, in particular from 40 wt % to 60 wt %, of a mixture of the diol (C) and the polyethylene glycol (D) is desirable.

The mixing ratio of the diol (C), the polyethylene glycol (D) and the dicarboxylic acid or the derivative thereof (F) from which the polyester compounds of this invention are constituted can have any value, but the range of from 30 wt % to 75 wt %, in particular from 40 wt % to 60 wt %, of a mixture of the diol (C) and the polyethylene glycol (D) is desirable.

The polymers represented by general formula (I) of this invention can be prepared by the polymerization of the monomers mentioned above which have at least two polymerizable ethylenically unsaturated groups such that at least one is included in a side chain to provide the repeating unit A in the formula, the monomers mentioned above which have one polymerizable ethylenically unsaturated group to provide the repeating units B in the formula, and the monomers which can be represented by the general formula (VII).

$$CH_2{=}\overset{\overset{R^1}{|}}{C}{-}\underset{\underset{L_1}{|}}{\overset{\overset{R^2}{|}}{CH}}{-}\overset{\overset{R^3}{|}}{CH}{-}O\Big)_m R^4 \qquad (VII)$$

(In this formula, $R^1$, $R^2$, $R^3$, $R^4$, $L_1$ and m all have the same meaning as described above.)

The above mentioned polymerization reaction can be carried out using any of the generally known methods of solution polymerization, emulsion polymerization, suspension polymerization, sedimentation polymerization and dispersion polymerization. However, in cases where x is not zero in general formula (I) it is necessary to use emulsion polymerization or dispersion polymerization to provide a stable dispersion of very fine particles.

The above mentioned methods of polymerization have been described in detail on pages 1 to 50 of *Experimental Methods in Polymer Science*, published by the Tokyo Kagaku Dojin Co. (1981), on pages 218–243 of the second edition of *An Introduction to Polymer Chemistry*, published by the Kagaku Dojin Co (1982), and in *Dispersion Polymerization in Organic Media*, by K. J. Barrett et al., published by John Wiley & Sons (1975).

Emulsion polymerization is especially desirable amon9 these methods of polymerization. The above mentioned emulsion polymerization is carried out in an aqueous solvent, generally in the presence of an emulsifying agent selected from the anionic surfactants (for example sodium dodecylsulfonate, Triton 770 (made commercially by the Rohm & Haas Co.)), the cationic surfactants (for example, octadecyl trimethyl ammonium chloride) and the nonionic surfactants (for example Emarex NP-20 (made commercially by Nippon Emulsion)), gelatin, or poly(vinyl alcohol) for example, and a radical polymerization initiator (for example, potassium persulfate, or the compound sold under the trade name V-50 from Wako Pure Chemical Industries, Ltd.) at a temperature of from 40° C. to 100° C., and preferably at a temperature of from 50° C. to 80° C.

No particular limitation is imposed upon the method of manufacture of a polyurethane compound of this invention, and methods in which the diisocyanate (E) is reacted with a mixture of dialcohol (C) and polyethylene glycol (D) can be suitably adopted.

The temperature of the above mentioned synthesis reaction is preferably from 30° C. to 150° C., and reaction at a temperature of from 50° C. to 80° C. is especially desirable. Furthermore, the addition of a tertiary amine (for example tetramethylethylenediamine or 4-dimethylaminopyridine) or an organo tin compound (for example dibutyl tin laurate, dioctyl tin laurate) as a catalyst, to promote the reaction between the isocyanate groups and the hydroxyl groups is preferred.

Moreover, an appropriate organic solvent may be used during the reaction in order to prevent the reaction products from solidifying or to prevent the viscosity rising to too high a level. A solvent which is inert with respect to isocyanate but in which the reaction products are soluble is preferably used as the solvent. Examples of such solvents include ketones (for example acetone, methyl ethyl ketone), ethers (for example, tetrahydrofuran, ethyleneglycol dimethyl ether, diethylene glycol dimethyl ether, dioxane), alkyl halides (for example chloroform, dichloroethane), aromatic hydrocarbons (for example benzene, toluene, chlorobenzene) and amides (for example N,N-dimethylformamide, N,N-dimethylacetamide). The solvents can be removed using the usual methods, as required.

No particular limitation is imposed upon the method for the manufacture of the polyester compounds of this invention, and methods in which the dicarboxylic acid or derivative thereof (F) is reacted with a mixture of the dialcohol (C) and the polyethylene glycol (D) can be suitably adopted.

The temperature of the above mentioned synthesis reaction is preferably from 30° C. to 250° C., and most desirably from 50° C. to 170° C. The reaction is carried out under reduced pressure with a view to the removal of the water, methanol or hydrogen chloride etc. which is produced by the reaction. The reaction between the hydroxyl groups and the carboxylic acid or derivative thereof is preferably facilitated in this way.

Moreover, a suitable organic solvent can be used during the reaction with a view to preventing the solidification of the reaction products and to preventing the viscosity from reaching too high a level. The use of a solvent with is inert with respect to carboxylic acid groups and in which the reaction products dissolve is preferred. Examples of such solvents include ketones (for example acetone, methyl ethyl ketone), ethers (for example, tetrahydrofuran, ethylene glycol dimethyl ether, diethylene glycol dimethyl ether, dioxane), alkyl halides (for example chloroform, dichloroethane), aromatic hydrocarbons (for example benzene, toluene, chlorobenzene) and amides (for example N,N-dimethylformamide, N,N-dimethylacetamide). The solvents can be removed using the usual methods, as required.

Moreover, reference can be made to *Experimental Methods in Macromolecular Chemistry*, by Yoshio Iwakura, Eiichi Masuhara, Shigeyuki Suzuki and Naotake Okada (Asakura Shoten, 1965), pages 172–182, and *Polyester Resin Handbook*, edited by Eiichi Takiyama (Nikkan Kogyo Shinbunsha, 1988) pages 45–48 and 52–74, in connection with methods for the manufacture of the polyesters.

Reference can be made to the aforementioned *Experimental Methods in Macromolecular Chemistry*), pages 186–187, and pages 197–204, and *Polyurethane*, Bridgestone Tire Co., Nippon Trading Co. (Maki Shoten, 1960) in connection with the synthesis of the polyurethanes.

Examples of preferred macromolecular compounds which can be used in this invention are indicated below, but the invention is not limited to these illustrative compounds.

Illustrative Compounds (Compounds which can be represented by the above mentioned general formula (I))

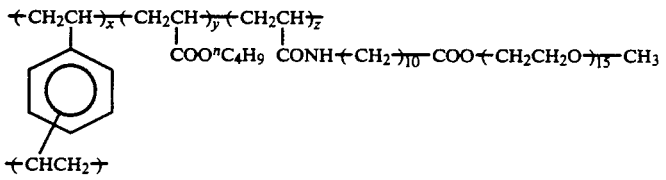

(P-1)

x/y/z = 10/40/50
Latex of Average Particle Size 104 nm

-continued
(P-2)
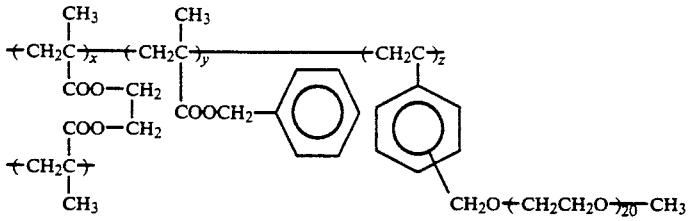
x/y/z = 10/50/40
Latex of Average Particle Size 125 nm
(P-3)
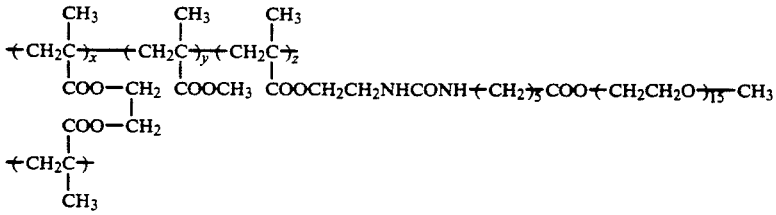
x/y/z = 15/40/45
Latex of Average Particle Size 117 nm
(P-4)
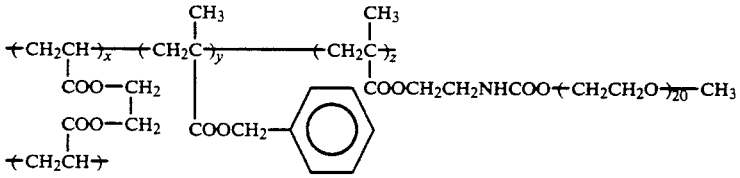
x/y/z = 5/65/30
Latex of Average Particle Size 98 nm
(P-5)
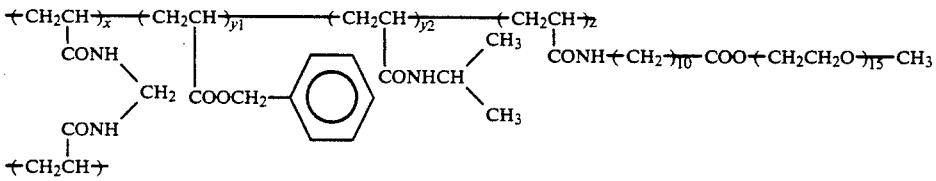
$x/y_1/y_2/z$ = 15/30/20/35
Latex of Average Particle Size 175 nm
(P-6)
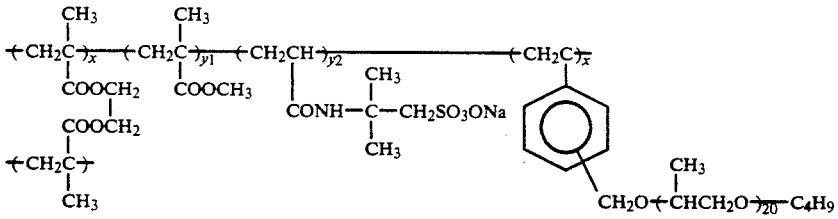
$x/y_1/y_2/z$ = 20/30/7/43
Latex of Average Particle Size 121 nm
(P-7)
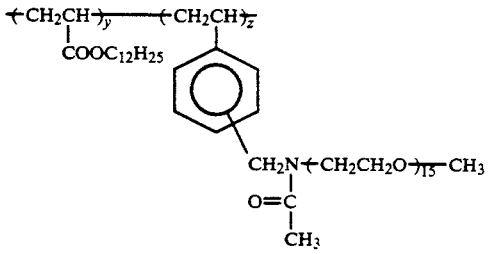
y/z = 40/60
Average Molecular Weight 138,000 ($M\overline{w}$)
Ethyl Acetate Solution (Concentration 14.5 wt%)

-continued $$\left(CH_2CH\right)_{\overline{}}$$
$$\mid$$
$$CONH-(CH_2)_{10}-COO(CH_2CH_2O)_{15}-CH_3 \quad \text{(P-8)}$$

Average Molecular Weight 96,000 ($\overline{Mw}$)
Latex of Average Particle Size 84 nm (Polyurethane Compounds) The numbers in parentheses indicate the ratio by weight when the polyethylene glycol content is set at 100:

(P-9) Reaction product of (C) 1,6-Hexanediol, (D) Polyethylene glycol of average molecular weight 1000 and (E) 2,4-Toluenediisocyanate (C:D:E=70:100:120);

(P-10) Reaction Product of (C) 1,12-Dodecanediol, (D) Polyethylene glycol of average molecular weight 1000 and (E) 2,4-Toluenediisocyanate (C:D:E=40:100:36);

(P-11) Reaction Product of (C) 1,4-Cyclohexanediol, (D) Polyethylene glycol of average molecular weight 600 and (E) 2,4-Toluenediisocyanate (C:D:E=35:100:81);

(P-12) Reaction Product of (C) 1,6-Hexanediol, (D) Polyethylene glycol of average molecular weight 800 and (E) isopherone diisocyanate (C:D:E=120:100:221); and (P-13) Reaction Product of ($C_1$) 1,6-Hexanediol, ($C_2$) 1,4-Benzenediethanol, (D) Polyethylene 91ycol of average molecular weight 1600 and (E) 2,4-Toluenediisocyanate ($C_1$:$C_2$:D:E=20:40:100:82).

(Polyester Compounds}The numbers in parentheses indicate the ratio by weight when the polyethylene glycol content is set at 100:

(P-14) Reaction product of (C) Ethylene glycol, (D) Polyethylene glycol of average molecular weight 1000 and (F) Dimethyl terephthalate (C:D:F=34:100:129);

(P-15) Reaction product of (C) 1,4-Butanediol, (D) Polyethylene glycol of average molecular weight 1600 and (F) Dimethyl terephthalate (C:D:F=142:100:318);

(P-16) Reaction product of (C) 1,6-Hexanediol, (D) Polyethylene glycol of average molecular weight 2200 and (F) Dimethyl adipate (C:D:F=90:100:181);

(P-16) Reaction product of (C) Ethylene glycol, (D) Polyethylene glycol of average molecular weight 1600 and (F) p-Xylylenedicarboxylic acid dimethyl ester (C:D:F=50:100:193);

(P-18) Reaction product of ($C_1$) 1,6-Hexanediol, ($C_2$) 1,12-Dodecanediol, (D) Polyethylene glycol of average molecular weight 1000 and (F) Dimethyl terephthalate ($C_1$:$C_2$:D:F=30:40:100:114); and (P-19) Reaction product of (C) Ethylene glycol, (D) Polyethylene glycol of molecular weight 1600, ($F_1$) Poly(ethylene terephthalate)dicarboxylic acid of molecular Weight 3000, ($F_2$) Dimethyl terephthalate (C:D:$F_1$:$F_2$=80:100:420:235).

Examples of the Synthesis of compounds which are preferred in this invention are described below.

Synthesis Example 1: The Preparation of Compound P-1 Preparation of $CH_2=CH-CONH-(CH_2)_{10}COO-(CH_2CH_2O)_{15}CH_{35}$--CH°

Sodium hydroxide (20 grams, 0.5 mol) and 100.6 grams (0.5 mol) of 10-aminoundecanoic acid were introduced into a 1 liter three necked flask which was provided with a cooling tube and dissolved in 400 ml of water. After cooling to 5° C., 45.3 grams (0.5 mol) of acrylic acid chloride was added dropwise, with stirring, over a period of 1 hour. After the dropwise addition had been completed the reaction was continued for 2 hours at room temperature and then for 2 hours after heating to 60° C. Then the reaction mixture was cooled to room temperature and adjusted to pH 7.0 using sulfuric acid. The compound which precipitated out was removed by filtration and washed thoroughly with water, after which it was dried under reduced pressure and 97.8 grams of a white powder was obtained (yield 76%). The structure of this compound was analyzed using $^1$H-NMR and IR spectroscopy and it was shown to be $CH_2=CH-CONH-(CH_2)_{10}COOH$ (referred to hereinafter as compound 1).

Next 51.4 grams (0.2 mol) of compound 1 and 300 ml of acetone were introduced into a 1 liter three necked flask which was furnished with a cooling tube and, after thorough agitation, 41.3 grams (0.2 mol) of dicyclohexylcarbodiimide was added. The mixture was stirred for 1 hour while maintaining a temperature of 40° C. A solution of 69.2 grams (0.1 mol) of $HO-(CH_2CH_2O)_{15}CH_3$ dissolved in 200 ml of acetone was then added dropwise over a period of 1 hour, after which the reaction mixture was heated to 60° C. and refluxed for 4 hours. After the reaction had been completed the reaction mixture was cooled, the insoluble material was removed by filtration and the solvent was distilled off under reduced pressure. Ethyl acetate (600 ml) was added to the residue and the insoluble material was removed by filtration, after which 300 ml of saturated salt water was added to the ethyl acetate solution so obtained and the mixture was shaken in a separating funnel. The mixture was left to stand and separate, and then the oil layer was recovered and washed twice more with 300 ml of saturated salt water using the procedure described above. The ethyl acetate solution which had been washed in this way was taken and the solvent was distilled off under reduced pressure. Then 600 ml of methanol was added and all of the material was dissolved. This solution was passed over 400 grams of an ion exchange resin (Amberlite IRA-400, produced commercially by Japan Organo Co., Ltd.) which had been thoroughly washed beforehand with methanol and then, after removing the methanol under reduced pressure, a further 600 grams of ethyl acetate was added and a solution was obtained. This ethyl acetate solution was dried overnight using magnesium sulfate and then the solvent was distilled off and 86.4 grams of a light yellowish brown waxy compound was obtained. Yield 93%. The purity of the compound was confirmed using high performance liquid chromatography and the structure was confirmed using $^1$H-NMR and IR spectroscopy. (This is referred to below as compound 2)

Preparation of Compound (P-1)

N-Methyl-oleic acid tauride, sodium salt (1.7 grams, $4.0\times10^{-3}$ mol) and 500 ml of distilled water were introduced into a 1 liter three necked flask which was furnished with a stirring device and a cooling tube and the mixture was heated to 80° C. under a current of nitrogen and stirred. Next, 0.2 gram ($7.4\times10^{-4}$ mol) of potassium persulfate was added to this solution and, after stirring for a period of 5 minutes, a monomer solution (a solution obtained by dissolving 25.0 grams (0.027 mol) of compound 2, 5.0 grams (0.038 mol) of divinylbenzene and 20.0 grams (0.156 mol) of n-butyl acrylate in 50 ml of methanol) which had been prepared separately was drip fed into the mixture over a period of 1 hour. After completion of the drip feed, 0.2 grams of potassium persulfate was added and the mixture was stirred for 1 hour and then a further 0.2 gram of potassium persulfate was added and the reaction was continued for 5 hours. The latex liquid which was obtained on returning the reaction liquid to room temperature was filtered through a filter paper of pore size 10 μm and 571.3 grams of a latex liquid of Compound (P-1) was obtained. The solid fraction was 8.7 wt % (solid fraction yield 95%).

Synthesis Example 2: The Preparation of Compound (P-4) Preparation of

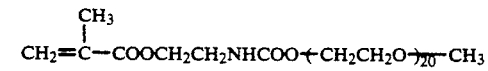

Toluene (300 ml), 23.3 grams (0.15 mol) of 2-isocyanatoethyl methacrylate (a commercial product, trade name MOI made by the Showa Rodia Chemical Co.) and 91.3 grams (0.1 mol) of $HO-(CH_2CH_2O)_{20}CH_3$ were introduced into a 1 liter three necked flask which was furnished with a cooling tube and the mixture was stirred at room temperature to form a solution. At this point 0.1 gram of hydroquinone monomethyl ether as a polymerization inhibitor and 0.1 gram of dibutyl tin laurate as a reaction promoter were added. The temperature was raised to 75° C. and the mixture was reacted for 6 hours. After the reaction had been completed, the toluene was distilled off under reduced pressure, 300 ml of ethyl acetate was added to form a solution, and the insoluble material was removed. The ethyl acetate solution so obtained was washed by shaking with 300 ml of saturated salt water. After repeating this washing process three times, the ethyl acetate phase was recovered and dried with the addition of 15 grams of magnesium nitrate, the ethyl acetate was distilled off and 98.3 grams of a light yellow waxy compound was obtained. The purity and structure of the compound so obtained were confirmed using high performance liquid chromatography and $^1$H-NMR and IR spectroscopy (Yield 92%, referred to hereinafter as compound 3)

Preparation of Compound (P-4)

N-Methyl-oleic acid tauride, sodium salt (1.7 grams, $4.0\times10^{-3}$ mol) and 500 ml of distilled water were introduced into a 1 liter three necked flask which was furnished with a stirring device and a cooling tube and the mixture was heated to 80° C. and stirred under a current of nitrogen. Next, 0.2 gram ($7.4\times10^{-4}$ mol) of potassium persulfate was added to this solution and, after stirring the mixture for 5 minutes, a monomer solution (a solution obtained by dissolving 15.0 grams (0.014 mol) of compound 3, 2.5 grams (0.015 mol) of diethyleneglycol diacrylate and 32.5 grams (0.1946 mol) of benzyl methacrylate in 50 ml of methanol) which had been prepared separately was added dropwise over a period of 1 hour. After the drip feed had been completed, 0.2 gram of potassium persulfate was added and the mixture was stirred for 1 hour and then a further 0.2 gram of potassium persulfate was added and the mixture was reacted for a period of 5 hours. The latex liquid obtained on cooling the reaction liquid back down to room temperature was filtered through a filter paper of pore size 10 μm and 568.8 grams of a latex liquid of compound P-4 was obtained. The solid fraction was 8.6 wt % (solid fraction yield 94%).

Synthesis Example 3: The Preparation of Compound (P-10)

Polyethylene glycol of an average molecular weight 1000 (100 grams, 0.10 mol), 40 grams (0.11 mol) of 1,12-dodecanediol and 500 ml of dimethylacetamide were introduced into a 1 liter three necked flask which had been furnished with a stirrer, a thermometer and a cooling tube and the mixture was stirred to form a solution. 2,4-Toluenediisocyanate (36 grams, 0.21 mol) was introduced into this solution and then 0.1 gram of dibutyl tin dilaurate was added and the temperature was raised to 70° C. and the mixture was reacted for 13 hours. The reaction solution was then cooled to room temperature, the dimethylacetamide solvent was removed under reduced pressure and 173.9 grams of compound (P-10) was obtained in the form of a sticky liquid. It was confirmed that the isocyanate group absorption had disappeared from the IR spectrum and that the absorption of a urethane bond had appeared. Compound (P-10) was dissolved in ethyl acetate and used as a 20 wt %

Synthesis Example 4: The Preparation of Compound (P-15)

Polyethylene glycol of an average molecular weight 1600 (100 grams, 0.0625 mol), 142 grams (1.58 mol) of 1,4-butanediol, 0.3 gram of p-toluenesulfonic acid, 318 grams (1.64 mol) of dimethyl terephthalate and 200 grams of xylene were introduced into a 1 liter three necked flask which had been furnished with a stirrer and a thermometer and heated to 130° C. to form a solution. This reaction liquid was reacted for 48 hours while maintaining a temperature of 130° C., and the methanol which was produced as a volatile material during this time was cooled using a condenser and removed from the system. The temperature was raised to 180° C. and the xylene solvent was removed and 504 grams of Compound (P-15) was obtained as a very viscous liquid. It was confirmed that the absorption due to the alcoholic hydroxyl group had virtually disappeared from the IR spectrum of the reaction product. Compound (P-15) was dissolved in ethyl acetate and used as a 20 wt % solution.

No particular limitation is imposed upon the method of using the polymers of this invention, but in general they are preferably used in the form of a latex or after dispersion in an aqueous solution in the form of fine particles by emulsification and dispersion. The fine particles which are used are preferably of an average particle size from 10 nm to 2 μm, and most desirably of an average particle size of from 50 nm to 1 μm.

The polymer used in this invention may be used in any layer of the silver halide photographic photosensitive material. They can be used in photosensitive silver halide emulsion layers and also in protective layers, filter layers, intermediate layers which do not contain silver halide emulsions and emulsion layers which contain silver halide emulsions of which the sensitivity to light can be essentially disregarded. Furthermore, they may be used conjointly in the same layers as couplers which have been emulsified and dispersed using high boiling point organic solvents and macromolecular polymers for emulsification and dispersion purposes, or couplers which have been emulsified and dispersed without the special use of high boiling point organic solvents. No particular limitation is imposed upon the amount of the polymer of this invention which is added to the silver halide photographic photosensitive material. But the amount calculated as the polyethylene oxide contained therein is preferably from 0.1 to 1000 $mg/m^2$, more desirably from 0.3 to 700 $mg/m^2$, even more desirably from 1 to 400 $mg/m^2$, and most desirably from 2 to 200 $mg/m^2$.

The silver halide emulsion which is used in this invention is preferably subjected to chemical sensitization.

No particular limitation is imposed upon the conditions of chemical sensitization in this invention, but the pAg value may be from 6 to 11, preferably from 7 to 10, and most desirably from 7 to 9.5, and the temperature may be from 40° C. to 95° C. and preferably from 50° C. to 85° C.

Noble metal sensitizing agents such as gold, platinum, palladium and iridium for example are preferably used conjointly in this invention. The conjoint use of gold sensitizing agents is especially desirable, and in practice use can be made of chloroauric acid, potassium chloroaurate, potassium aurithiocyanate, gold sulfide and gold selenide for example and these can be used in amounts on the order of from $10^{-7}$ to $10^{-2}$ mol per mol of silver halide.

Moreover, the conjoint use of sulfur sensitizing agents is desirable in this invention. In practice, known unstable sulfur compounds such as thiosulfate (for example hypo), thioureas (for example diphenylthiourea, triethylthiourea, allylthiourea), and rhodanines can be used. These compounds can be used in amounts of some $10^{-7}$ to $10^{-2}$ mol per mol of silver halide.

Reduction sensitizing agents can also be used conjointly in this invention. For instance, stannous chloride, aminoiminomethanesulfinic acid, hydrazine derivatives, borane compounds, silane compounds and polyamine compounds can be used.

Furthermore, the execution of selenium sensitization in the presence of silver halide solvents is desirable in this invention.

In practice, these solvents include thiocyanate (for example potassium thiocyanate), thioether compounds (for example, the compounds disclosed, for example, in U.S. Pat. Nos. 3,021,215 and 3,271,157, JP-A No. 60 136736, and especially 3,6-dithia-1,8-octanediol), tetra-substituted thiourea compounds (for example, the compounds disclosed in JP-B No. 59-11892 and U.S. Pat. No. 4,221,863, and especially tetramethylthiourea), and the thione compound disclosed in JP-B No. 60-11341, the mercapto compounds disclosed in JP-B No. 63-29727, the meso-ionic compounds disclosed in JP-A No. 60-163042, the selenoether compounds disclosed in U.S. Pat. No. 4,782,013, the telloether compounds disclosed in Japanese Patent Application No. 63-173474 (corresponding to JP-A No. 2-118566) and sulfite. Among these compounds, thiocyanate, thioether compounds, tetra-substituted thiourea compounds and thione compounds are preferred. They can be used in amounts of from $10^{-5}$ to $5\times10^{-2}$ mol per mol of silver halide.

The silver halide emulsions used in this invention are preferably silver bromide, silver iodobromide, silver iodochlorobromide, silver chlorobromide or silver chloride emulsions.

The silver halide grains which are used in this invention may have a regular crystalline form such as a cubic or octahedral form, or they may have an irregular crystalline form such as a spherical or plate-like form, or they may have a composite form comprised of these crystalline forms. Furthermore, emulsions comprised of mixtures of grains of various crystalline forms can also be used, but the use of grains which have a regular crystalline form is preferred.

The silver halide grains which are used in this invention may be such that the interior part and the surface layer form different phases, or the grains may consist of a uniform phase. Furthermore, the grains may be of the type with which the latent image is formed principally on the surface (for example, negative type emulsions) or of the type with which the latent image is formed principally within the grains (for example internal latent image type emulsions, pre-fogged direct reversal type emulsions). Grains of the type with which the latent image is formed principally on the surface are preferred.

The silver halide emulsions used in this invention are preferably tabular grain emulsions in which grains of a thickness of not more than 0.5 microns, and preferably not more than 0.3 microns, of a diameter preferably of at least 0.6 microns, and of an average aspect ratio of at least 5, account for at least 50% of the total projected area, or mono-disperse emulsions of which the statistical variation coefficient (the value $S/\bar{d}$ obtained by dividing the standard deviation S by the diameter $\bar{d}$ for a distribution represented by the diameters in cases where the projected areas are approximately circular) is less than 20%. Furthermore, two or more types of tabular grain emulsion and mono-disperse emulsion may be mixed together.

The photographic emulsions used in the invention can be prepared using the methods described, for example, by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsion*, published by Focal Press, 1964.

Furthermore, ammonia, potassium thiocyanate, ammonium thiocyanate, thioether compounds (for example, those disclosed, for example, in U.S. Pat. Nos. 3,271,157, 3,574,628, 3,704,130, 4,297,439 and 4,276,374), thione compounds (for example, those disclosed, for example, in JP-A No. 53-144319, JP-A No. 53-82408 and JP-A No. 55-77737), and amine compounds (for example, those disclosed, for example, in JP-A No. 54-100717) can be used as silver halide solvents for controlling grain growth during silver halide grain formation.

Cadmium salts, zinc salts, thallium salts, iridium salts or complex salts thereof, rhodium salts or complex salts thereof, or iron salts or complex salts thereof, for example, may also be present during the formation or physical ripening processes of the silver halide grains.

Gelatin is useful as a binding agent or protective colloid which can be used in the emulsion layers or intermediate layers of a photosensitive material of this invention, but other hydrophilic colloids can be used for this purpose. For example, proteins such as gelatin derivatives, graft polymers of other polymers with gelatin, albumin and casein; sugar derivatives such as cellulose derivatives such as hydroxyethylcellulose, carboxymethylcellulose and cellulose sulfate esters, sodium alginate, and starch derivatives; and various synthetic hydrophilic polymeric materials, for example homopolymers or copolymers such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole, can be used for this purpose.

In addition, general purpose lime-processed gelatins, acid-processed gelatins and enzyme-processed gelatins, as disclosed in *Bull. Soc. Sci. Phot. Japan*, No. 16, page 30 (1966), can be used as the gelatin, and gelatin hydrolyzates can also be used.

The photosensitive materials of this invention may contain inorganic or organic hardening agents in any of the hydrophilic colloid layers which form the photographic photosensitive layer or the backing layer. Chromium salts, aldehydes (for example, formaldehyde, glyoxal, glutaraldehyde) and N-methylol compounds (for example, dimethylolurea) are examples of such compounds. Active halogen compounds (for example, 2,4-dichloro-6-hydroxy-1,3,5-triazine and its sodium salt) and active vinyl compounds (for example, 1,3-bis-vinylsulfonyl-2-propanol, 1,2-bis(vinylsulfonylacetamido)ethane, bis(vinylsulfonylmethy) ether or vinyl based polymers which have vinyl groups in side chains) are preferred for rapidly hardening the hydrophilic colloids such as gelatin and providing stable photographic characteristics. N-Carbamoylpyridinium salts (for example, (1-morpholinocarbonyl-3-pyridinio)methanesulfonate) and haloamidinium salts (for example, 1-(1-chloro-1-pyridinomethylene)pyrrolidinium-2-naphthalenesulfonate) are also excellent for providing rapid hardening rates.

The silver halide photographic emulsions of this invention may be spectrally sensitized using methine dyes or by other means. The dyes which can be used include cyanine dyes, merocyanine dyes, complex cyanine dyes, complex merocyanine dyes, holopolar cyanine dyes, hemicyanine dyes, styryl dyes and hemioxonol dyes. Dyes classified as cyanine dyes, merocyanine dyes and complex merocyanine dyes are especially useful dyes. All of the nuclei generally used in cyanine dyes can be used for the basic heterocyclic nuclei in these dyes. That is to say, the nucleus may be a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus. It may also be a nucleus in which one of these nuclei is fused with an aliphatic hydrocarbon ring or a nucleus in which one of these nuclei is fused with an aromatic hydrocarbon ring, which is to say an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus or a quinoline nucleus for example. These nuclei may be substituted on the carbon atoms.

The nucleus which has a ketomethylene structure in the merocyanine dyes or complex merocyanine dyes may be a five- or six-membered heterocyclic nucleus, for example a pyrazolin-5-one nucleus, a thiohydantoin nucleus, a 2-thio-oxazolidin-2,4-dione nucleus, a thiazolidin-2,4-dione nucleus, a rhodanine nucleus or a thiobarbituric acid nucleus.

These sensitizing dyes may be used individually or they may be used in combination. Combinations of sensitizing dyes are often used in particular with the intention of achieving supersensitization. Substances or dyes which exhibit supersensitization, being dyes which themselves have no spectrally sensitizing action or substances which essentially do not absorb visible light, can be included in an emulsion together with the sensitizing dyes. For example, substituted aminostilbene compounds with a nitrogen containing heterocyclic group (for example, those disclosed in U.S. Pat. Nos. 2,933,390 and 3,635,721), aromatic organic acid/formaldehyde condensates (for example, those disclosed in U.S. Pat. No. 3,743,510), and cadmium salts and azaindene compounds, for example, may be included. The combinations disclosed in U.S. Pat. Nos. 3,615,613, 3,615,641, 3,617,295 and 3,635,721 are especially useful.

Various compounds can be included in the silver halide photographic emulsions which are used in this invention with a view, for example, to preventing the occurrence of fogging during the manufacture, storage or photographic processing of the photosensitive material, or with a view to stabilizing photographic performance. Thus, many compounds which are known as antifogging agents or stabilizers, such as azoles, for example benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mecaptotetrazoles (especially 1-phenyl-5-mercaptotetrazole); mercaptopyrimidines; mercaptotriazines, thioketo compounds such as oxazolinethione for example; azaindenes, for example triazaindenes, tetraazaindenes (especially 4-hydroxy substituted (1,3,3a,7)-tetraazaindenes) and pentaazaindenes; benzenethiosulfonic acid, benzenesulfinic acid and benzenesulfonic acid amide, for example, can be added for this purpose.

One or more types of surfactant may be included in the photosensitive material of this invention for various purposes, for example as coating promoters, as antistatic agents, for improving slip properties, for emulsification and dispersion purposes, for the prevention of sticking or for improving photographic characteristics (for example, for accelerating development, increasing contrast or increasing photographic speed).

Photosensitive materials which have been made according to this invention may contain water soluble dyes in the hydrophilic colloid layer as filter dyes, for the prevention of irradiation or halation, or for various other purposes. Oxonol dyes, hemioxonol dyes, styryl dyes, merocyanine dyes, anthraquinone dyes and azo dyes are preferably used as dyes of this type, but cyanine dyes, azomethine dyes, triarylmethane dyes and phthalocyanine dyes are also useful in this connection. Oil soluble dyes can be emulsified using the oil in water dispersion method and added to the hydrophilic colloid layers.

This invention can be applied to multi-layer, multicolor photographic materials which have layers of at least two different spectral sensitivities on a support. Multi-layer natural color photographic materials are generally comprised of a support on which there are provided at least one red-sensitive emulsion layer, at least one green-sensitive emulsion layer and at least one blue-sensitive emulsion layer. The order of these layers can be changed optionally, as required. The preferred layer arrangements are, from the support side, red-sensitive layer, green-sensitive layer, blue-sensitive layer; from the support side, blue-sensitive layer, green-sensitive layer, red-sensitive layer or, from the support side, blue-sensitive layer, red-sensitive layer, green-sensitive layer.

Furthermore, any of the emulsion layers of the same color sensitivity may be comprised of two or more emulsion layers which have different photographic speeds to improve the speed achieved, and graininess can be improved by using triple layer structures.

Furthermore, photo-insensitive layers may be present between two or more emulsion layers which have the same color sensitivity. Structures in which an emulsion layer which has a different color sensitivity is introduced between certain emulsion layers which have the same color sensitivity can also be used. The establishment of a reflecting layer, such as a fine grained silver halide layer, below the highest speed layer, and especially below the highest speed blue-sensitive layer, may be used to increase photographic speed.

Cyan forming couplers are generally included in the red-sensitive emulsion layer, magenta forming couplers are generally included in the green-sensitive emulsion layer, and yellow forming couplers are generally included in the blue-sensitive emulsion layer, but different combinations can be used, depending on the particular case. For example, with the incorporation of an infrared-sensitive layer, the materials can be used for making false color photographs and as materials for use with semiconductor laser exposures.

Various color couplers can be used in a photographic material of in this invention, examples of which have been disclosed in the patents cited in the aforementioned *Research Disclosure* No. 17643, sections VII-C-G.

Those disclosed, for example, in U.S. Pat. Nos. 3,933,501, 4,022,620, 4,326,024 and 4,401,752, JP-B No. 58-10739, British Patent Nos. 1,425,020 and 1,467,760 are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent No. 73,636, U.S. Pat. Nos. 3,061,432 and 3,725,067; Research Disclosure No. 24220 (June 1984), JP-A No. 60-33552, Research Disclosure No. 24230 (June 1984), JP-A No. 60-43659 and U.S. Pat. Nos. 4,500,630 and 4,540,654 are especially desirable.

Phenol based and naphthol based couplers can be cited as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Appication (OLS) No. 3,329,729, European Patent 121,365A, U.S. Pat. Nos. 3,446,622, 4,333,999, 4,451,559 and 4,427,767, and European Patent No. 161,626A are preferred.

Colored couplers for correcting unwanted absorptions of colored dyes may be used, and those disclosed, for example, in section VII-G of Research Disclosure No. 17643, U.S. Pat. No. 4,163,670, JP-B No. 57-39413, U.S. Pat. Nos. 4,004,929 and 4,138,258, and British Patent No. 1,146,368 are preferred.

The couplers disclosed in U.S. Pat. No. 4,366,237, British Patent No. 2,125,570, European Patent No. 96,570 and West German Patent Application (OLS) No. 3,234,533 are preferred as couplers which form the colored dyes having a suitable degree of diffusibility.

Typical examples of polymerized dye forming couplers have been disclosed, for example, in U.S. Pat. Nos. 3,451,820, 4,080,211 and 4,367,282, and British Pat. No. 2,102,173.

Couplers which release photographically useful residual groups upon coupling can be used preferably in this invention. The DIR couplers which release development inhibitors disclosed in the patents cited in section VII-F of the aforementioned *Research Disclosure* 17643, JP-A No. 57-151944, JP-A No. 57-154234, JP-A No. 60-184248, and U.S. Pat. No. 4,248,962 are preferred.

The couplers disclosed in British Patents 2,097,140 and 2,131,188, JP-A No. 59-157638 and JP-A No. 59-170840 are preferred as couplers which imagewise release nucleating agents or development accelerators during development.

Other couplers which can be used in a photosensitive material of this invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compounds or DIR coupler releasing couplers disclosed, for example, in JP-A No. 60-185950 and JP-A No. 62-24252, the couplers which release dyes for which the color is restored after elimination disclosed in European Patent No. 173,302A, the bleach accelerator releasing couplers disclosed, for example, in Research Disclosure No. 11449, ibid, No. 24241 and JP-A No. 61-201247, and the ligand releasing couplers disclosed, for example, in U.S. Pat. No. 4,553,477.

The couplers which can be used in this invention can be introduced into a photosensitive material by various known dispersion methods.

Examples of high boiling point solvents which can be used in the oil in water dispersion method have been disclosed, for example, in U.S. Pat. No. 2,322,027.

Examples of the high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)-isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate and trichloropropyl phosphate, and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, iso-stearyl alcohol and 2,4-di-tert-amylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and diisopropylnaphthalene). Furthermore, organic solvents which have a boiling point above about 30° C., and preferably of at least 50° C., but below about 160° C., can be used as auxiliary solvents. Typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and examples of latexes for loading purposes have been disclosed, for example, in U.S. Pat. No. 4,199,363, and in West German Patent Applications (OLS) 2,541,274 and 2,541,230.

The photographic emulsion layers and other layers in a photographic material of this invention can be coated onto a flexible support, such as a plastic film, paper or cloth for example, of the type generally used for photographic photosensitive materials, or onto a rigid support, such as glass, porcelain or metal, for example. Useful flexible supports include, for example, films made of semi-synthetic or synthetic polymers, such as cellulose nitrate, cellulose acetate, cellulose acetate butyrate, polystyrene, poly(vinyl chloride), poly(ethylene terephthalate) or polycarbonate for example, and papers which have been coated or laminated with a baryta layer or an o-olefin polymer (for example polyethylene, polypropylene, ethylene/butene copolymer). The support may be colored using dyes or pigments. The support may also be colored black for light shielding purposes. The surface of the support is generally undercoated in order to improve adhesion with the photographic emulsion layer for example. The surface of the support may be subjected to a glow discharge treatment, a corona discharge treatment, ultraviolet irradiation or a flame treatment, for example, before or after the undercoating treatment.

Coating of the photographic emulsion layers and other hydrophilic colloid layers can be achieved using a variety of known coating methods, for example using dip coating, roller coating, curtain coating, or extrusion coating methods. Multi-layers can be coated simultaneously using the methods disclosed, for example, in U.S. Pat. Nos. 2,681,294, 2,761,791, 3,526,528 and 3,508,947, as required.

This invention can be applied to various color and black-and-white photosensitive materials. Typical applications include color negative films for general and cinematographic purposes, color reversal films for slides and television purposes, color papers, color positive films and color reversal papers, color diffusion transfer type photosensitive materials, and heat-developable type color photosensitive materials. The invention can also be applied to black-and-white photosensitive materials such as those intended for X-ray purposes in which the tri-color coupler mixtures disclosed, for example, in *Research Disclosure,* No. 17123 (published July 1978) are used, or in which the black color forming couplers disclosed, for example, in U.S. Pat. No. 4,126,461 and British Patent No. 2,102,136, are used. The invention can also be applied to printing plate making films, such as lith films and scanner films, to X-ray films intended for use in direct or indirect medical applications or industrial applications, to camera black-and-white negative films, to black-and-white printing papers, to microfilms for COM or general purposes, to silver salt diffusion transfer type photosensitive materials and to print-out type photosensitive materials.

When a photographic element of this invention is applied to a color diffusion transfer photographic method it may have a peel apart type structure or a unified (integrated) type construction as disclosed in JP-B No. 46-16356, JP-B No. 48-33697, JP-A No. 50-13040 or British Patent No. 1,330,524, or it may be constructed as a film unit in which peeling apart is unnecessary as disclosed in JP-A No. 57-119345.

The use of a polymer acid layer which is protected by a neutral timing layer is useful for widening the permissible processing temperature range with any of the above mentioned formats. In those cases where a color diffusion transfer photographic method is used, the polymer acid may be added to any layer in the photosensitive material, or to a processing fluid container in which the developer components are sealed.

Various means of exposure can be used with photosensitive materials of this invention. Any light source which emits radiation with a band width corresponding to the sensitive wavelengths of the photosensitive material can be used for providing a light source or a write-in light source. Natural light (sunlight), incandescent electric lamps, sealed halogen lamps, mercury lamps, fluorescent lamps or flash lamps such as strobes and burning metal flash lamps, for example, can be used. Gas, dye solutions or semiconductor lasers which emit light in wavelength regions from the ultraviolet region through the infrared region, light emitting diodes, and plasma light sources can also be used as light sources for recording purposes.

Furthermore, exposing devices such as a fluorescent screen (CRT) with which light is released from phosphors which have been excited by a electron beam for example or in which a beam-like or surface-type light source is combined with a micro-shutter array such as a liquid crystal display (LCD) or a lead titanium zirconate doped with lanthanum (PLZT) device, for example, can also be used. The spectral distribution of light which is used to make an exposure can be adjusted, as required, using color filters.

The color developers used for the development processing of photosensitive materials of this invention are preferably aqueous alkaline solutions which contain primary aromatic amine based color developing agents as the principal component. Aminophenol based compounds are also useful, but p-phenylenediamine based compounds as color developing agents are preferred. Typical examples of these compounds include 3-methyl-4-amino-N,N-diethylaniline, 3-methyl-4-amino N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts, for example, of these compounds. These diamines are generally more stable in the form of salts than in their free state, and the use of the salts is therefore preferred.

Moreover, pH buffers, such as alkali metal carbonates, borates or phosphates, and development inhibitors or anti-foggants, such as bromide, iodide, benzimidazoles, benzothiazoles or mercapto compounds, are generally included in the color developer. Moreover, preservatives such as hydroxylamine or sulfite, organic solvents such as triethanolamine and diethylene glycol, development accelerators such as benzyl alcohol, polyethylene glycol, quaternary ammonium salts and amines, dye forming couplers, competitive couplers, nucleating agents such as sodium borohydride, auxiliary developing agents such as 1-phenyl-3-pyrazolidone, thickeners, various chelating agents typified by the aminopolycarboxylic acids, aminopolyphosphonic acids, alkylphosphonic acids and phosphonocarboxylic acids, and the antioxidants disclosed in West German Patent Application (OLS) 2,622,950, for example, may be added, as required, to the color developer.

Color development is carried out after normal black-and-white development in the development processing of reversal color photosensitive materials. Known black-and-white developing agents, for example dihydroxybenzenes such as hydroquinone, 3-pyrazolidones such as 1-phenyl-3-pyrazolidone, or aminophenols such as N-methyl-p-aminophenol, can be used individually or in combination in the black-and-white developer.

The color developed photographic emulsion layer is generally subjected to a bleaching process. The bleaching process can be carried out at the same time as a fixing process or it may be carried out separately. Moreover, a method of processing in which bleach-fixing is carried out after a bleaching process can be used in order to speed up processing. Compounds of multivalent metals, such as iron(III), cobalt(III), chromium(IV) and copper(II), peracids, quinones, and nitroso compounds, for example, can be used as bleaching agents. Thus, ferricyanide; dichromate; organic complex salts of iron(III) or cobalt(III), for example complex salts with aminopolycarboxylic acids such as ethylenediamine tetraacetic acid, diethylenetriamine pentaacetic acid, nitrilotriacetic acid, 1,3-diamino-2-propanol tetraacetic acid, or with organic acids such as citric acid, tartaric acid or malic acid for example; persulfate; manganate; and nitrosophenol can be used as bleaching agents. Of these, ethylenediaminetetraacetic acid iron(III) salts, diethylenetriaminepentaacetic acid iron(III) salts and persulfate are preferred from the point of view of rapid processing and avoiding environmental pollution. Moreover, the ethylenediaminetetraacetic acid iron(III) complex salts are especially useful in both independent bleach baths and single bath bleach-fix baths.

Bleaching accelerators can be used, as required, in the bleach baths, bleach-fix baths and bleach or bleach-fix pre-baths. Examples of useful bleach accelerators include: the compounds which have a mercapto group or a disulfide group disclosed, for example, in U.S. Pat. No. 3,893,858, West German Patent Nos. 1,290,812 and 2,059,988, JP-A No. 53-32736, JP-A No. 53-57831, JP-A No. 53-37418, JP-A No. 53-65732, JP-A No. 53-72623, JP-A No. 53-95630, JP-A No. 53-95631, JP-A No. 53-104232, JP-A No. 53-124424, JP-A No. 53-141623, JP-A No. 53-28426, and *Research Disclosure*, No. 17129 (July 1978); the thiazolidine derivatives disclosed in JP-A No. 50-140129; the thiourea derivatives disclosed in JP-B No. 45-8506, JP-A No. 52-20832, JP-A No. 53-32735 and U.S. Pat. No. 3,706,561; the iodide disclosed in West German Patent No. 1,127,715 and JP-A No. 58-16235; the polyethylene oxides disclosed in West German Patent Nos. 966,410 and 2,748,430; the polyamine compounds disclosed in JP-B No. 45-8836; the other compounds disclosed in JP-A No. 49-2434, JP-A No. 49-59644, JP-A No. 53-94927, JP-A No. 54-35727, JP-A No. 55-26506 and JP-A No. 58-163940; and iodine and bromine ions. Among these compounds, those which have a mercapto group or a disulfide group are preferred in view of their large accelerating effect, and the compounds disclosed in U.S. Pat. No. 3,893,858, West German Patent No. 1,290,812 and JP-A No. 53-95630 are especially desirable. Moreover, the compounds disclosed in U.S. Pat. No. 4,552,834 are also desirable. These bleach accelerators may also be added to the photosensitive material. These bleaching accelerators are especially effective with bleach-fixing camera color photosensitive materials.

Thiosulfate, thiocyanate, thioether based compounds, thioureas and large amounts of iodide can be used, for example, as fixing agents, but thiosulfates are generally used. Sulfites, bisulfites, or carbonyl/bisulfite addition compounds are preferred as preservatives for bleach-fix baths and fixer baths.

A water washing process and a stabilization process are generally carried out after the bleachfixing process or fixing process. Various known compounds can be added in the water washing and stabilizing processes with a view to preventing sedimentation and economizing on water usage. For example, water softening agents such as inorganic phosphoric acid, aminopolycarboxylic acids, organic aminopolyphosphonic acid and organic phosphoric acids, can be added for preventing sedimentation, and disinfectants and biocides and metal salts as typified by magnesium salts, aluminum salts and bismuth salts can be added for preventing the growth of various bacteria, algae and fungi. Further, surfactants and various hardening agents can be added, as required, to reduce the drying load and to prevent unevenness. Alternatively, the compounds disclosed by L. E. West in *Phot. Sci. Eng.*, Vol 6, pages 344–359 (1965) may be added. The addition of chelating agents and biocides is especially effective.

Counter-current water washing with two or more tanks is generally employed in the water washing process to economize on water. Moreover, multi-stage countercurrent stabilization processes such as that disclosed in JP-A-57-8543 can be used in place of a water washing process. In this case, a counter-current system which has from two to nine tanks is required. Various compounds for stabilizing the image may be added to the stabilizing bath in addition to the additives aforementioned. For example, various buffers (for example, combinations of borates, metaborates, borax, phosphates, carbonates, potassium hydroxide, sodium hydroxide, aqueous ammonia, monocarboxylic acids, dicarboxylic acids and polycarboxylic acids can be used) for controlling the film pH (for example to a pH from 3 to 9), and aldehydes such as formaldehyde, are typical of such compounds. Furthermore, various additives, such as chelating agents (for example, inorganic phosphoric acid, aminopolycarboxylic acids, organic phosphoric acids, organic phosphonic acids, aminopolyphosphonic acids and phosphonocarboxylic acids), disinfectants (for example, benzoisothiazolinone, isothiazolone, 4-thiazolinbenzimidazole, halogenated phenols, sulfanilamide and benzotriazole), surfactants, brightening agents and hardening agents, for example, may be used, as required. Two or more types of compound can also be used conjointly for the same or different purposes.

Furthermore, various ammonium salts, such as ammonium chloride, ammonium nitrate, ammonium sulfate, ammonium phosphate, ammonium sulfite and ammonium thiosulfate, are preferably added as post-processing film pH adjusting agents.

Furthermore, the post-fixing (water washing-stabilization) processes which are generally used with camera color photosensitive materials can also be replaced with the aforementioned stabilization processes and water washing processes (processing with economical water usage). In such a case it is desirable that formaldehyde be removed from the stabilizing bath when a two-equivalent magenta coupler is involved.

The water washing and stabilization processing times in this invention differ according to the type of photosensitive material and the processing conditions, but the time is generally between 20 seconds and 10 minutes, and preferably between 20 seconds and 5 minutes.

Color developing agents can be incorporated into a silver halide color photosensitive material of this invention with a view to simplifying and speeding up processing. The use of various color developing agent precursors is preferred for this purpose. For example, the indoaniline based compounds disclosed in U.S. Pat. No. 3,342,597, the Schiff's base type compounds disclosed in U.S. Pat. No. 3,342,599 and *Research Disclosure,* No. 4850, and ibid, No. 15159, the aldol compounds disclosed in *Research Disclosure,* No.13924, the metal complex salts disclosed in U.S. Pat. No. 3,719,492 and the urethane based compounds disclosed in JP-A No. 53-135628, and also the various salt type precursors disclosed, for example, in JP-A No. 56-6235, JP-A No. 56-16133, JP-A No. 56-59232, JP-A No. 56-106241, JP-A No. 56-107236, JP-A No. 57-97531 and JP-A No. 57-83565 can be used for this purpose.

Various 1-phenyl-3-pyrazolidones can be incorporated, as required, into a silver halide color photosensitive material of this invention with a view to accelerating color development. Typical compounds have been disclosed, for example, in JP-A No. 56-64339, JP-A No. 57-144547, JP-A No. 57-211147, JP-A No. 58-50532, JP-A No. 58-50536, JP-A No. 58-50533, JP-A No. 58-50534, JP-A No. 58-50535 and JP-A No. 58-115438.

The various processing baths in this invention are maintained at a temperature of from 10° C. to 50° C. The standard temperature is generally from 33° C. to 38° C., but accelerated processing and shorter processing times can be realized at higher temperatures while increased image quality and improved processing bath stability can be achieved at lower temperatures. Furthermore, processes using cobalt intensification or hydrogen peroxide intensification, as disclosed in West German Patent No. 2,226,770 or U.S. Pat. No. 3,674,499, can be used in order to economize on the amount of silver in the photosensitive material.

Heaters, temperature sensors, liquid level sensors, circulating pumps, filters, floating lids and squeegees etc., may be established, as required, in each of the various processing baths.

Furthermore, replenishers can be used for the various processing baths when continuous processing is being carried out, and a constant finish can be obtained by preventing fluctuation in bath composition in this way. The replenishment can be made at half, or less than half, the standard replenishment rate in order to reduce costs.

A bleach-fix process is generally used in the case where the photosensitive material of this invention is a color paper, and a bleach-fix process can be used as required in the case where the photosensitive material of this invention is a camera color photographic material.

EFFECTS OF THE INVENTION (1) It is possible to accelerate the development of a specified photosensitive layer.
(2) It is possible to suppress completely the effects on photographic layers other than the target layer.
(3) It is possible to suppress changes in photographic performance due to ageing.
(4) It is possible to harden the contrast of a specified layer.

The invention will now be explained by the following examples which should not be considered as limiting the scope of the invention.

EXAMPLE 1

A multi-layer color photosensitive material comprised of layers having the composition indicated below was prepared on a cellulose triacetate film support of thickness 205 μm on both sides of which an underlayer had been established. This is Sample No. 101.

The coated weights are shown as values per square meter of sample. Moreover, in the case of silver halides and colloidal silver the weight shown is the weight calculated as the silver equivalent.

| | |
|---|---|
| First Layer: Anti-halation Layer | |
| Black colloidal silver | 0.25 gram |
| Gelatin | 1.9 grams |
| Ultraviolet absorber U-1 | 0.04 gram |
| Ultraviolet absorber U-2 | 0.1 gram |
| Ultraviolet absorber U-3 | 0.1 gram |
| Ultraviolet absorber U-4 | 0.1 gram |
| Ultraviolet absorber U-6 | 0.1 gram |
| Additive P'-1 | 0.1 gram |
| Additive F-10 | 0.2 gram |
| High boiling point organic solvent Oil-1 | 0.1 gram |
| Second Layer: Intermediate Layer | |
| Gelatin | 0.40 gram |
| Compound Cpd-D | 10 mg |
| Dye D-4 | 0.4 mg |
| High boiling point organic solvent Oil-3 | 40 mg |
| Dye D-6 | 0.1 gram |
| Third Layer: Intermediate Layer | |
| Fine grained photo-insensitive silver iodobromide emulsion (average grain size 0.1 μm, AgI content 1 mol %) | 0.15 grams as silver |
| Fine grained silver iodobromide emulsion of which the surface and interior had been fogged (average gain size 0.06 μm, variation coefficient 18%, AgI content 1 mol %) | 0.05 gram as silver |
| Additive N-1 | 0.05 gram |
| Gelatin | 0.4 gram |
| Fourth Layer: Low Speed Red-Sensitive Emulsion Layer | |
| Emulsion A | as silver 0.2 gram |
| Emulsion B | as silver 0.3 gram |
| Gelatin | 0.8 gram |
| Compound Cpd-K | 0.05 gram |
| Coupler C-1 | 0.15 gram |
| Coupler C-2 | 0.05 gram |
| Coupler C-9 | 0.05 gram |
| Coupler C-10 | 0.10 gram |
| Compound Cpd-D | 10 mg |
| Additive F-2 | 0.1 mg |
| High boiling point organic solvent Oil-2 | 0.10 gram |
| Additive F-12 | 0.5 mg |
| Fifth Layer: Medium Speed Red-Sensitive Emulsion Layer | |
| Emulsion B | as silver 0.2 gram |
| Emulsion C | as silver 0.3 gram |
| Gelatin | 0.8 gram |
| Additive F-13 | 0.05 mg |
| Coupler C-1 | 0.2 gram |
| Coupler C-2 | 0.05 gram |
| Coupler C-3 | 0.2 gram |
| Additive F-2 | 0.1 mg |
| High boiling point organic solvent Oil-2 | 0.1 gram |
| Sixth Layer: High Speed Red-Sensitive Emulsion Layer | |
| Emulsion D | as silver 0.4 gram |
| Gelatin | 1.1 grams |
| Coupler C-3 | 0.7 gram |
| Coupler C-1 | 0.3 gram |
| Additive P'-1 | 0.1 gram |
| Additive F-2 | 0.1 mg |
| Seventh Layer: Intermediate Layer | |
| Gelatin | 0.6 gram |
| Anti-color mixing agent Cpd-L | 0.05 gram |
| Additive F-1 | 1.5 mg |
| Additive Cpd-N | 0.02 gram |
| Additive M-1 | 0.3 gram |

-continued

| | |
|---|---|
| Anti-color mixing agent Cpd-K | 0.05 gram |
| Ultraviolet absorber U-1 | 0.1 gram |
| Ultraviolet absorber U-6 | 0.1 gram |
| Dye D-1 | 0.02 gram |
| Dye D-6 | 0.05 gram |
| Eighth Layer: Intermediate Layer | |
| Silver iodobromide emulsion of which the surface and interior had been fogged (average gain size 0.06 μm, variation coefficient 16%, AgI content 0.3 mol %) | 0.02 gram as silver |
| Gelatin | 1.0 gram |
| Additive P'-1 | 0.2 gram |
| Anti-color mixing agent Cpd-J | 0.1 gram |
| Anti-color mixing agent Cpd-M | 0.05 gram |
| Anti-color mixing agent Cpd-A | 0.1 gram |
| Gelatin | 1.1 grams |
| Coupler C-3 | 0.7 gram |
| Coupler C-1 | 0.3 gram |
| Additive P'-1 | 0.1 gram |
| Additive F-2 | 0.1 mg |
| Seventh Layer: Intermediate Layer | |
| Gelatin | 0.6 gram |
| Anti-color mixing agent Cpd-L | 0.05 gram |
| Additive F-1 | 1.5 mg |
| Additive Cpd-N | 0.02 gram |
| Additive M-1 | 0.3 gram |
| Anti-color mixing agent Cpd-K | 0.05 gram |
| Ultraviolet absorber U-1 | 0.1 gram |
| Ultraviolet absorber U-6 | 0.1 gram |
| Dye D-1 | 0.02 gram |
| Dye D-6 | 0.05 gram |
| Eighth Layer: Intermediate Layer | |
| Silver iodobromide emulsion of which the surface and interior had been fogged (average gain size 0.06 μm, variation coeficient 16%, AgI content 0.3 mol %) | 0.02 gram as silver |
| Gelatin | 1.0 gram |
| Additive P'-1 | 0.2 gram |
| Anti-color mixing agent Cpd-J | 0.1 gram |
| Anti-color mixing agent Cpd-M | 0.05 gram |
| Anti-color mixing agent Cpd-A | 0.1 gram |
| Ninth Layer: Low Speed Green-Sensitive Emulsion Layer | |
| Silver iodobromide emulsion of which the interior of the grains had been fogged (Average grain size 0.1 μm, AgI content 0.1 mol %) | 0.05 gram as silver |
| Emulsion E | as silver 0.3 gram |
| Emulsion F | as silver 0.1 gram |
| Emulsion G | as silver 0.1 gram |
| Gelatin | 0.5 gram |
| Coupler C-4 | 0.20 gram |
| Coupler C-7 | 0.10 gram |
| Coupler C-8 | 0.10 gram |
| Coupler C-11 | 0.10 gram |
| Compound Cpd-B | 0.03 gram |
| Compound Cpd-E | 0.02 gram |
| Compound Cpd-F | 0.02 gram |
| Compound Cpd-G | 0.02 gram |
| Compound Cpd-H | 0.02 gram |
| Compound Cpd-D | 10 mg |
| High boiling point organic solvent Oil-2 | 0.2 gram |
| Tenth Layer: Medium Speed Green-sensitive Emulsion Layer | |
| Emulsion G | as silver 0.3 gram |
| Emulsion H | as silver 0.1 gram |
| Gelatin | 0.6 gram |
| Coupler C-4 | 0.1 gram |
| Coupler C-7 | 0.1 gram |
| Coupler C-8 | 0.1 gram |
| Coupler C-11 | 0.05 gram |
| Compound Cpd-B | 0.03 gram |
| Compound Cpd-E | 0.02 gram |
| Compound Cpd-F | 0.02 gram |
| Compound Cpd-G | 0.05 gram |
| Compound Cpd-H | 0.05 gram |
| High boiling point organic solvent Oil-2 | 0.01 gram |
| Eleventh Layer: High Speed Green-Sensitive Emulsion Layer | |

-continued

| | |
|---|---|
| Emulsion I | as silver 0.5 gram |
| Gelatin | 1.1 gram |
| Coupler C-4 | 0.4 gram |
| Coupler C-7 | 0.2 gram |
| Coupler C-8 | 0.2 gram |
| Coupler C-12 | 0.1 gram |
| Coupler C-9 | 0.05 gram |
| Compound Cpd-B | 0.08 gram |
| Compound Cpd-E | 0.02 gram |
| Compound Cpd-F | 0.02 gram |
| Compound Cpd-G | 0.02 gram |
| Compound Cpd-H | 0.02 gram |
| Additive F-2 | 0.3 mg |
| High boiling point organic solvent Oil-2 | 0.04 gram |
| Additive F-13 | 0.05 mg |
| Twelfth Layer: Intermediate Layer | |
| Gelatin | 0.8 gram |
| Additive F-1 | 2.0 mg |
| Dye D-1 | 0.1 gram |
| Dye D-3 | 0.07 gram |
| Dye D-8 | 0.03 gram |
| Dye D-2 | 0.05 gram |
| Thirteenth Layer: Yellow Filter Layer | |
| Yellow colloidal silver | as silver 0.1 gram |
| Gelatin | 1.3 grams |
| Dye D-5 | 0.05 gram |
| Anti-color mixing agent Cpd-A | 0.01 gram |
| High boiling point organic solvent Oil-1 | 0.01 gram |
| Dye D-7 | 0.03 gram |
| Additive M-2 | 0.01 gram |
| Fourteenth Layer: Intermediate Layer | |
| Gelatin | 0.6 gram |
| Dye D-9 | 0.02 gram |
| Fifteenth Layer: Low Speed Blue-Sensitive Emulsion Layer | |
| Emulsion J | as silver 0.4 gram |
| Emulsion K | as silver 0.1 gram |
| Emulsion L | as silver 0.1 gram |
| Gelatin | 0.9 gram |
| Coupler C-13 | 0.1 gram |
| Coupler C-5 | 0.6 gram |
| Additive F-2 | 0.2 mg |
| Sixteenth layer: Medium Speed Blue-Sensitive Emulsion Layer | |
| Emulsion L | as silver 0.5 gram |
| Gelatin | 1.2 grams |
| Coupler C-13 | 0.1 gram |
| Coupler C-5 | 0.3 gram |
| Coupler C-6 | 0.3 gram |
| Additive F-2 | 0.04 mg |
| Seventeenth Layer: High Speed Blue-Sensitive Emulsion Layer | |
| Emulsion M | as silver 0.2 gram |
| Emulsion N | as silver 0.4 gram |
| Gelatin | 1.4 grams |
| Coupler C-6 | 0.5 gram |
| Coupler C-14 | 0.2 gram |
| Additive F-2 | 0.4 mg |
| Additive F-9 | 1 mg |
| Eighteenth Layer: First Protective Layer | |
| Gelatin | 0.9 gram |
| Ultraviolet absorber U-1 | 0.04 gram |
| Ultraviolet absorber U-2 | 0.01 gram |
| Ultraviolet absorber U-3 | 0.03 gram |
| Ultraviolet absorber U-4 | 0.03 gram |
| Ultraviolet absorber U-5 | 0.05 gram |
| Ultraviolet absorber U-6 | 0.05 gram |
| High boiling point organic solvent Oil-1 | 0.02 gram |
| Formaldehyde scavenger | |
| Cpd-C | 0.2 gram |
| Cpd-I | 0.4 gram |
| Ethyl acrylate latex dispersion | 0.05 gram |
| Dye D-3 | 0.05 gram |
| Additive Cpd-J | 0.02 gram |
| Addiive F-1 | 1.0 mg |
| Additive Cpd-N | 0.01 gram |
| Additive F-6 | 1.0 mg |
| Additive M-2 | 0.05 gram |
| Nineteenth Layer: Second Protective Layer | |
| Colloidal silver | as silver 0.1 mg |

-continued

| | |
|---|---|
| Fine grained silver iodobromide emulsion (average grain size 0.06 μm, AgI content 1 mol %) | 0.1 gram as silver |
| Gelatin | 0.7 gram |
| Twentieth Layer: Third Protective Layer | |
| Gelatin | 0.7 gram |
| Poly(methyl methacrylate) (average particle size 1.5 μm) | 0.1 gram |
| Methyl methacrylate/acrylic acid (4:6) copolymer (average particle size 1.5 μm) | 0.1 gram |
| Silicone oil | 0.03 gram |
| Surfactant W-1 | 3.0 mg |
| Surfactant W-2 | 0.03 gram |
| Twenty First Layer: Backing Layer | |
| Gelatin | 10 grams |
| Ultraviolet absorber U-1 | 0.05 gram |
| Ultraviolet absorber U-2 | 0.02 gram |
| High boiling point organic solvent Oil-1 | 0.01 gram |
| Twenty Second Layer: Backing Protective Layer | |

-continued

| | |
|---|---|
| Gelatin | 5 grams |
| Poly(methyl methacrylate) (average particle size 1.5 μm) | 0.03 gram |
| Methyl acrylate and acrylic acid (4:6) copolymer (average particle size 1.5 μm) | 0.1 gram |
| Surfactant W-1 | 1 mg |
| Surfactant W-2 | 10 mg |

The additive F-1 was added to each silver halide emulsion layer.

Moreover, the gelatin hardening agent H-1, and the surfactants W-3 and W-4 for coating purposes and the surfactant W-5 for emulsification purposes were added to each layer in addition to the compositions indicated above.

Moreover, phenol, 1,2-benzisothiazolin-3-one, 2-phenoxyethanol, phenyl isothiocyanate and phenethyl alcohol were added as biocides and fungicides.

(C-1)

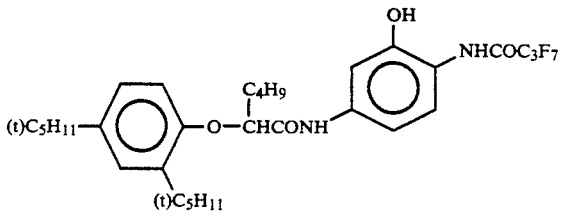

(C-2)

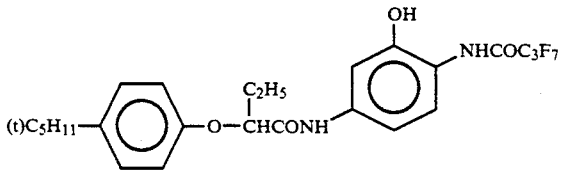

(C-3)

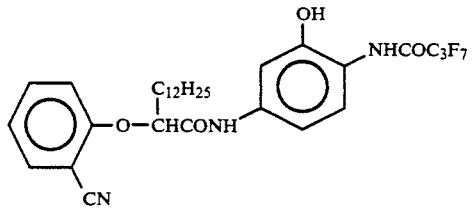

(C-4)

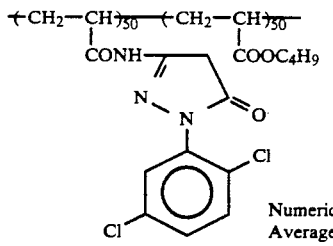

Numerical values indicate wt %
Average molecular weight: about 25,000

(C-5)

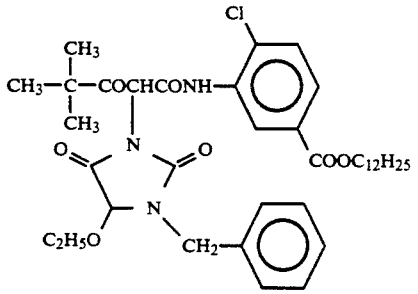

-continued
(C-6)
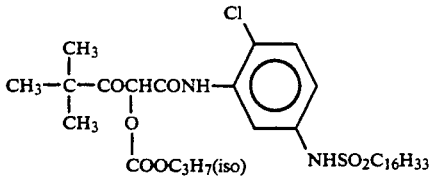
(C-7)
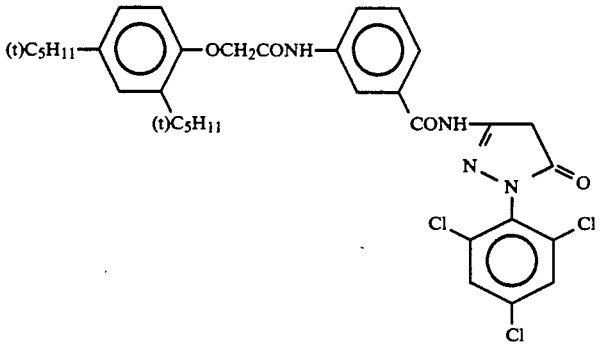
(C-8)
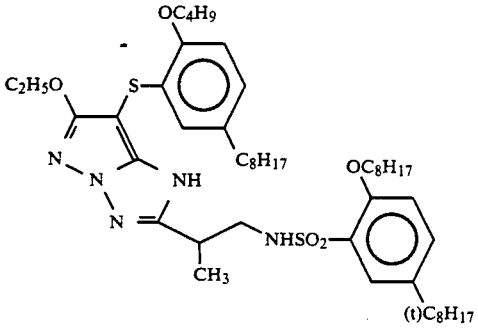
(C-9)
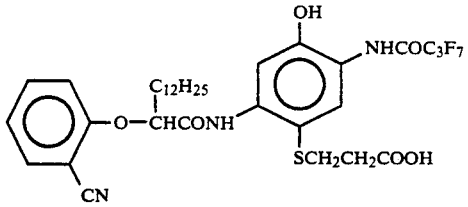
(C-10)
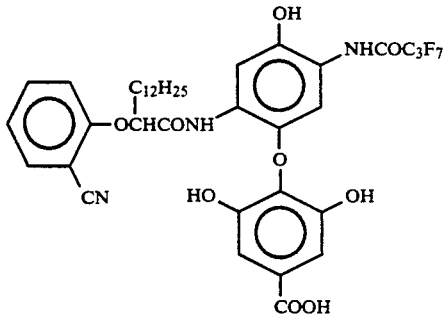

-continued
(C-11)
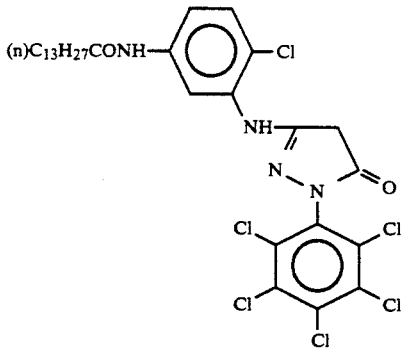
(C-12)
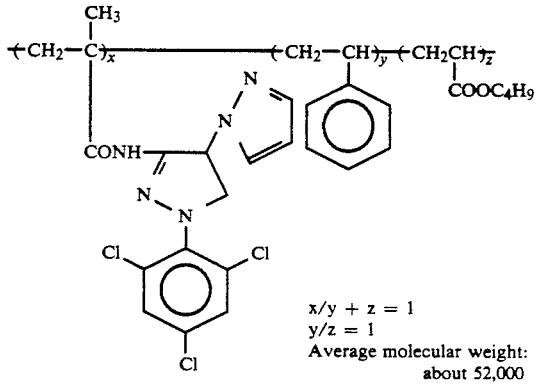
x/y + z = 1
y/z = 1
Average molecular weight: about 52,000
(C-13)
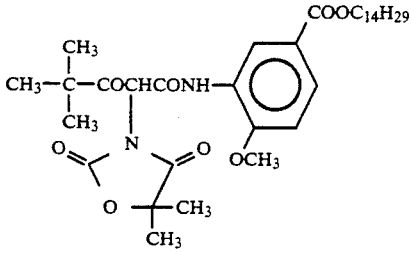
(C-14)
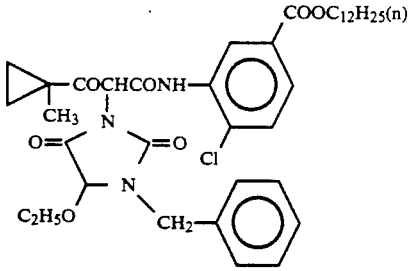
Dibutyl phthalate (Oil-1)
Tricresyl phosphate (Oil-2)
(Oil-3)
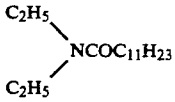
(Cpd-A)
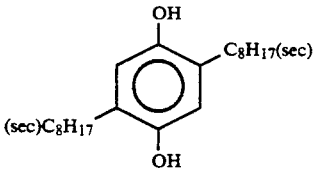

-continued
(Cpd-B)
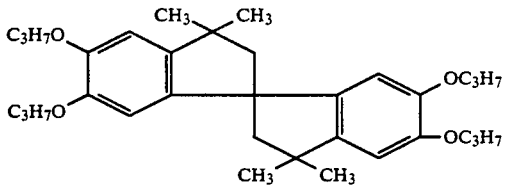
(Cpd-C)
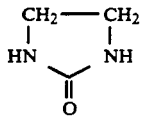
(Cpd-D)
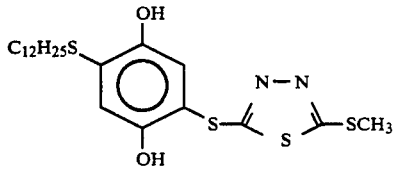
(Cpd-E)
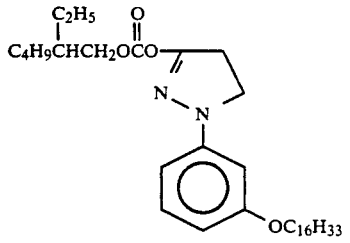
(Cpd-F)
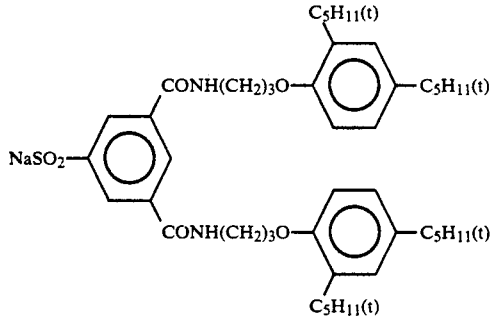
(Cpd-G)
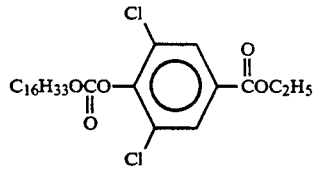
(Cpd-H)
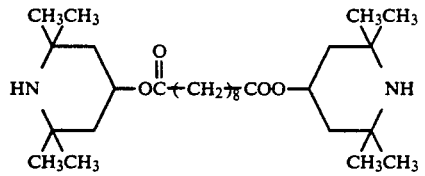
(Cpd-I)
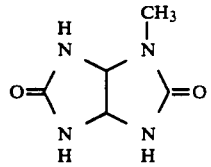

-continued
(Cpd-J)
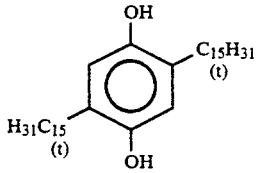
(Cpd-K)
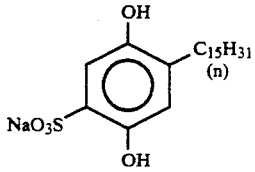
(Cpd-L)
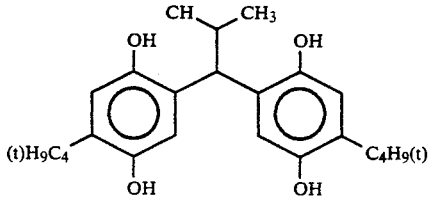
(Cpd-M)
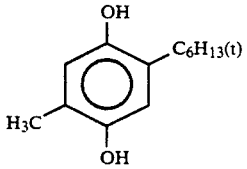
(Cpd-N)
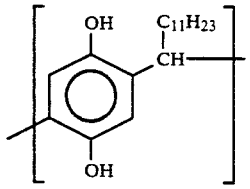
Average molecular weight:
about 9,000
(U-1)
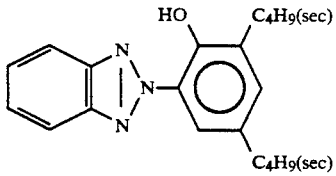
(U-2)
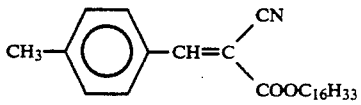
(U-3)
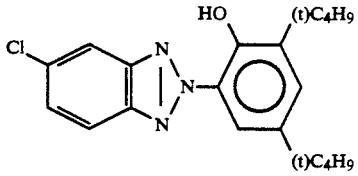
(U-4)
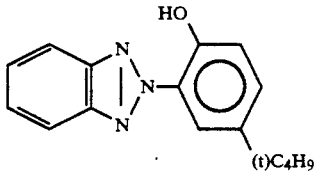

-continued
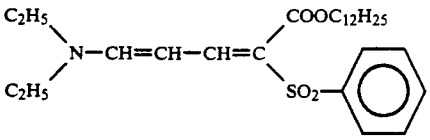
(U-5)
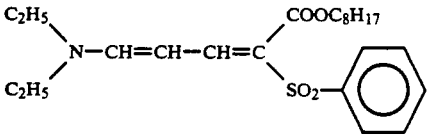
(U-6)
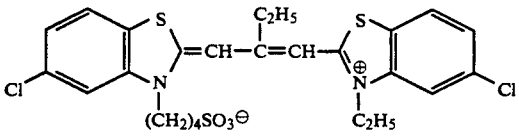
(S-1)
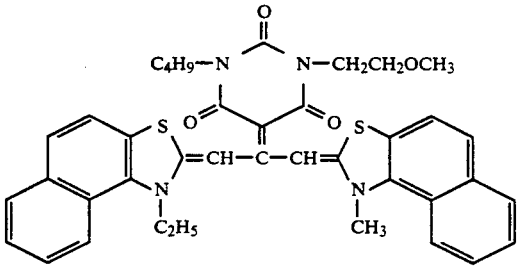
(S-2)
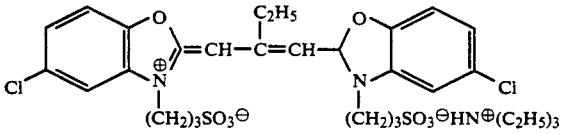
(S-3)
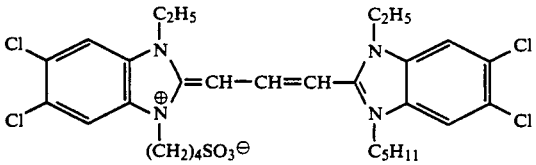
(S-4)
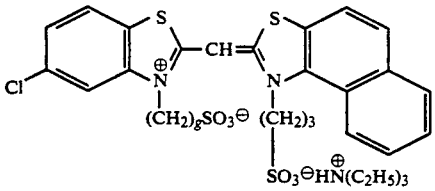
(S-5)
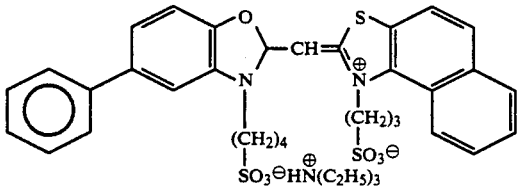
(S-6)
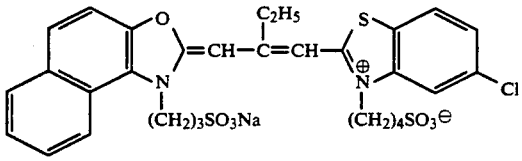
(S-7)

-continued
(S-8)
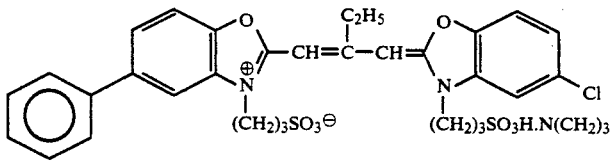
(S-9)
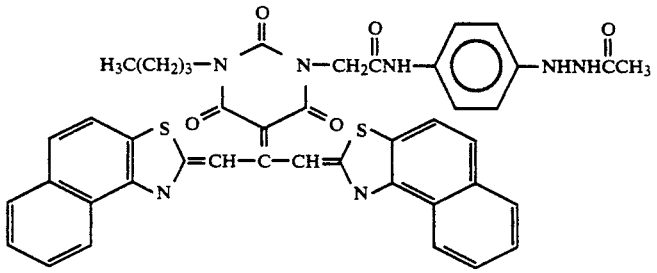
(S-10)
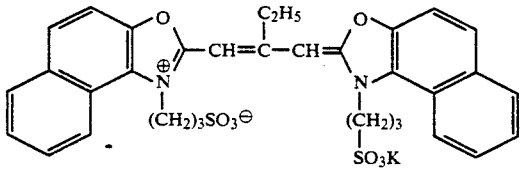
(D-1)
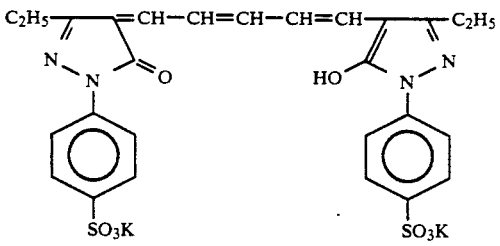
(D-2)
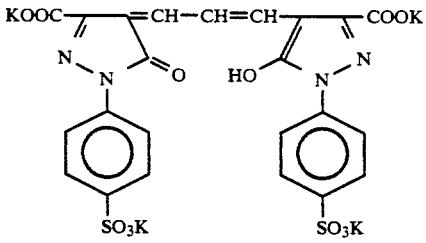
(D-3)
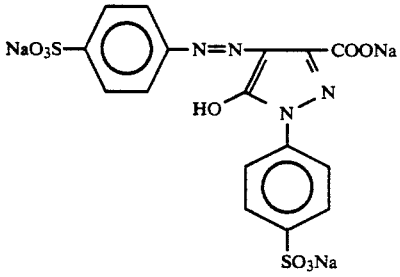

-continued
(D-4)
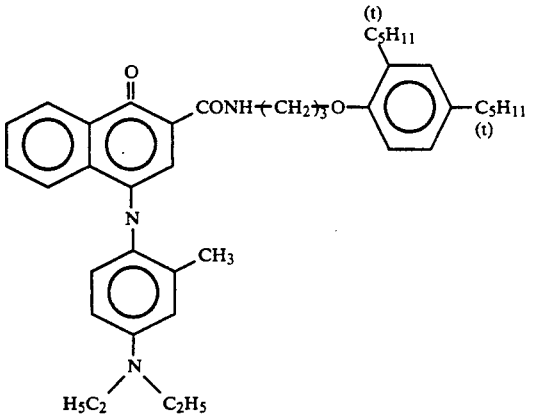
(D-5)
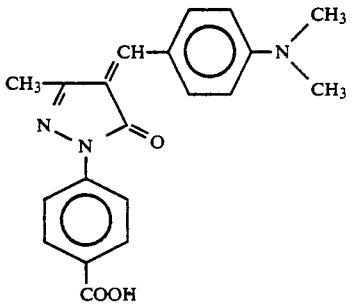
(D-6)
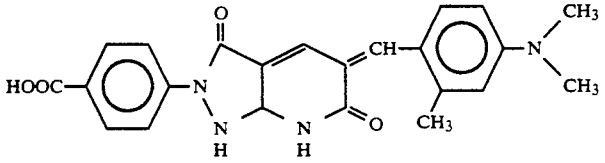
(D-7)
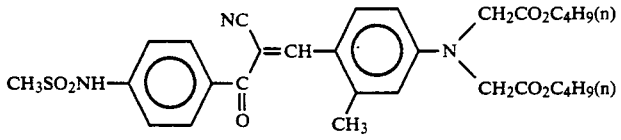
(D-8)
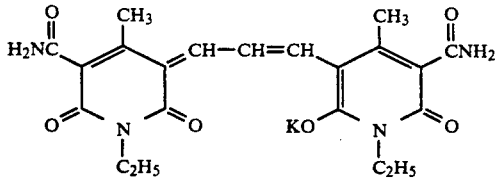
(D-9)
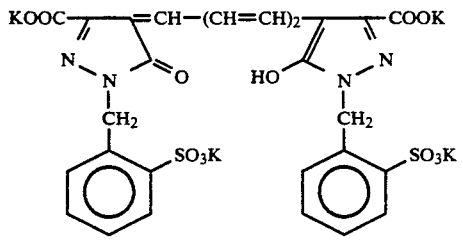
(H-1)
$CH_2{=}CHSO_2CH_2CONHCH_2$
$\quad\quad\quad -continued
(W-1)
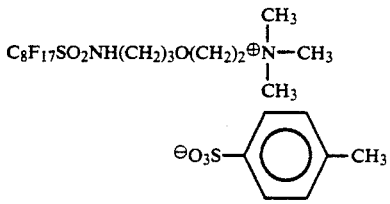
(W-2)
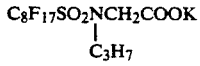
(W-3)
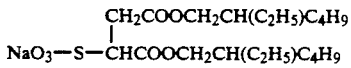
(W-4)
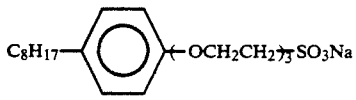
(W-5)
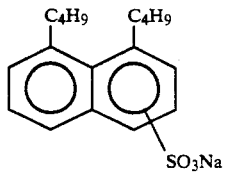
(P'-1)
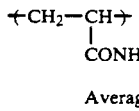
Average molecular weight: about 35,000
(M-1)
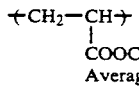
Average molecular weight: about 48,000
(M-2)
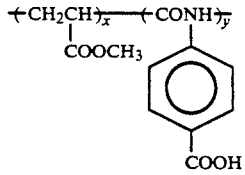
x/y = 1/1
Average molecular weight: about 25,000
(F-1)
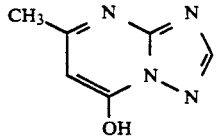
(F-2)
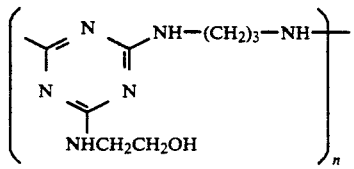
$-HNO_3$
Average molecular weight: about 8,200

-continued (F-6)

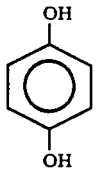

(F-9)

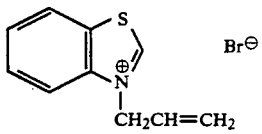

(F-10)

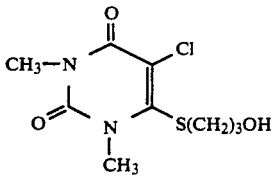

(F-12)

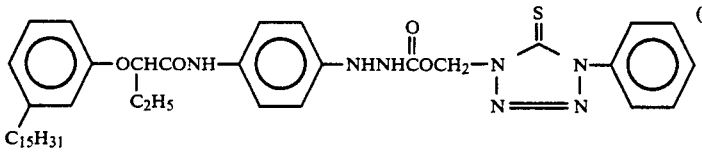

(F-13)

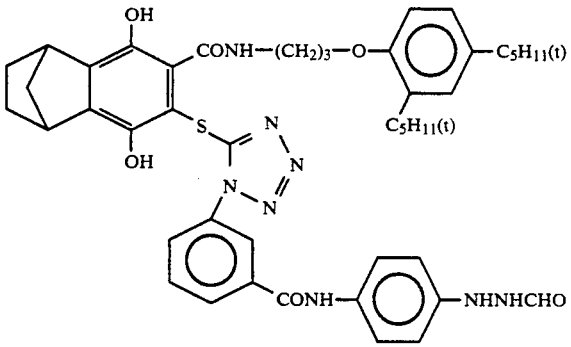

The silver iodobromide emulsions used in Sample No. 101 are indicated below.

| Emulsion | Grain Characteristics | Average Grain Size (μm) | Variation Coefficient (%) | AgI Content (%) |
|---|---|---|---|---|
| A | Mondisperse tetradecahedral grains | 0.35 | 16 | 4.5 |
| B | Monodisperse cubic internal latent image type grains | 0.45 | 10 | 5.0 |
| C | Monodisperse tetradecahedral grains | 0.60 | 18 | 4.0 |
| D | Polydisperse tabular grains average aspect ratio 4.0 | 1.10 | 25 | 3.0 |
| E | Monodisperse tabular grains average aspect ratio 5.0 | 0.45 | 17 | 4.0 |
| F | Monodisperse cubic grains | 0.35 | 16 | 4.0 |
| G | Monodisperse tabular grains average aspect ratio 4.5 | 0.55 | 17 | 4.5 |
| H | Monodisperse tetradecahedral grains | 0.65 | 9 | 3.5 |
| I | Polydisperse tabular grains average aspect ratio 5.3 | 1.20 | 28 | 3.0 |
| J | Monodisperse tabular grains average aspect ratio 3.8 | 0.70 | 18 | 4.5 |
| K | Polydisperse tabular grains average aspect ratio 4.0 | 0.60 | 29 | 6.0 |
| L | Monodisperse octahedral grains | 0.80 | 14 | 4.0 |
| M | Monodisperse tabular grains average aspect ratio 4.5 | 1.00 | 18 | 4.0 |
| N | Polydisperse tabular grains | 1.45 | 27 | 3.5 |

-continued average aspect ratio 3.5

Spectral Sensitization of Emulsions A to N

| Emulsion | Sensitizing Dye Added | Amount Added per Mol Silver Halide (gram) | Time at Which Sensitizing Dye Was Added |
|---|---|---|---|
| A | S-9 | 0.002 | Immediately after chemical sensitization |
| | S-1 | 0.025 | Immediately after chemical sensitization |
| | S-2 | 0.25 | Immediately after chemical sensitization |
| B | S-1 | 0.01 | Immediately after the end of grain formation |
| | S-2 | 0.25 | Immediately after the end of grain formation |
| C | S-1 | 0.02 | Immediately after chemical sensitization |
| | S-9 | 0.002 | Immediately after chemical sensitization |
| | S-2 | 0.25 | Immediately after chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-10 | 0.05 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after the end of grain formation |
| | S-4 | 0.08 | Immediately after the end of grain formation |
| H | S-3 | 0.2 | During grain formation |
| | S-10 | 0.1 | Immediately after grain sensitization |
| | S-4 | 0.06 | During grain formation |
| I | S-3 | 0.3 | Immediately before start of chemical sensitization |
| | S-4 | 0.07 | Immediately before start of chemical sensitization |
| | S-8 | 0.1 | Immediately before start of chemical sensitization |
| J | S-5 | 0.2 | During grain formation |
| | S-6 | 0.05 | During grain formation |
| K | S-5 | 0.2 | During grain formation |
| | S-6 | 0.05 | During grain formation |
| L | S-5 | 0.22 | Immediately after the end of grain formation |
| | S-6 | 0.06 | Immediately after the end of grain formation |
| M | S-5 | 0.15 | Immediately after chemical sensitization |
| | S-6 | 0.04 | Immediately after chemical sensitization |
| N | S-5 | 0.22 | Immediately after the end of grain formation |
| | S-6 | 0.06 | Immediately after the end of grain formation |

The percentage of the total projected area of the silver halide grains in each of the sixth, ninth, tenth, eleventh, fifteenth and seventeenth layers accounted for by the tabular silver halide grains having a grain diameter at least three times the grain thickness (aspect ratio at least 3) in Sample 101 was 85%, 70%, 73%, 85%, 82% and 90% respectively.

Preparation of Sample Nos. 102–115

Sample Nos. 102 to 107 of this invention and Comparative Sample Nos. 108 to 115 were prepared in the same way as Sample No. 101 except that the compounds of this invention and the comparative compounds shown in Table 1 were added to the seventeenth layer.

Sample Nos. 101 to 111 which had been prepared as described above were wedge exposed using white light of color temperature 5500° K. and then they were developed and processed using the processing operations indicated below. After which, density was measured using blue light, green light and red light, and the relative speeds were obtained from the exposures which gave a density of 2.0. The indication of a relative speed is given as the reciprocal of the exposure required and on the basis that the speed of Sample No. 101 was 100. Furthermore, the monitoring of photographic performance on ageing was carried out by leaving Sample Nos. 101 to 115 which had been prepared as described above to stand for 3 days under conditions of 50° C., 80% RH and then exposing, processing and measuring the density in the same way as before, reading off the density after storage under forced conditions of the exposed part which had a density of 1.0 before the samples were stored under the forced conditions. The change in photographic performance due to aging is represented by means of the value of the reduction in density ($\Delta D_{1.0}$).

The results are shown in Table 1.

Moreover, the coated weight of each compound is shown after calculation as the weight of the polyethylene oxide part in each compound.

(AB-1)

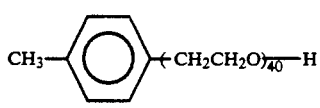

(AB-2)

$H(OCH_2CH_2)_n OH$

*Average Molecular Weight* 60,000

(AB-3)

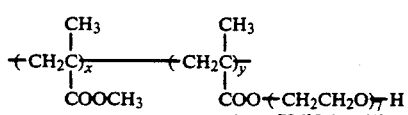

x/y = 70/30 (wt %)

Average Molecular Weight: about 41,000

(AB-4)

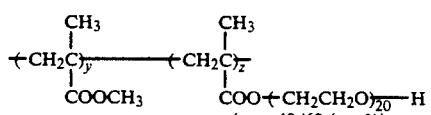

x/y = 40/60 (wt %)

Average Molecular Weight: about 28,000

Moreover, emulsification and dispersion was carried out in the usual way using W-5 and W-3 when P-10 and P-15 of this invention were added, and in the other cases the materials were added directly as aqueous dispersions.

| Processing Operations | | |
|---|---|---|
| Process | Time | Temperature |
| First Development | 6 minutes | 38° C. |
| Water Wash | 2 minutes | 38° C. |
| Reversal | 2 minutes | 38° C. |
| Color Development | 6 minutes | 38° C. |
| Conditioner | 2 minutes | 38° C. |
| Bleach | 6 minutes | 38° C. |
| Fix | 4 minutes | 38° C. |
| Water Wash | 4 minutes | 38° C. |
| Stabilization | 1 minute | Normal Temp. |
| Drying | | |

The compositions of the processing baths were as follows:

| | |
|---|---|
| First Developer | |
| Water | 700 ml |
| Pentasodium nitrilo-N,N,N-trimethylenephosphonate | 2 grams |
| Sodium sulfite | 30 grams |
| Potassium hydroquinone.monosulfonate | 20 grams |
| Potassium carbonate | 33 grams |
| 1-Phenyl-4-methyl-4-hydroxymethyl-3-pyrazolidone | 2 grams |
| Potassium bromide | 2.5 grams |
| Potassium thiocyanate | 1.2 grams |
| Potassium iodide | 2 mg |
| Water to make up to | 1000 ml |
| Reversal Bath | |
| Water | 700 ml |
| Pentasodium nitrilo-N,N,N-trimethylenephosphonate | 3 grams |
| Stannous chloride (di-hydrate) | 1 gram |
| p-Aminophenol | 0.1 gram |
| Sodium hydroxide | 8 grams |
| Glacial acetic acid | 15 ml |
| Water to make up to | 1000 ml |
| Color Developer | |
| Water | 700 ml |
| Pentasodium nitrilo-N,N,N-trimethylenephosphonate | 3 grams |

-continued

| | |
|---|---|
| Sodium sulfite | 7 grams |
| Tri-sodium phosphate (dodeca-hydrate) | 36 grams |
| Potassium bromide | 1 gram |
| Potassium iodide | 90 mg |
| Sodium hydroxide | 3 grams |
| Citrazinic acid | 1.5 grams |
| N-Ethyl-N-(β-methanesulfonamidoethyl)-3-methyl-4-aminoaniline sulfate | 11 grams |
| 3,6-Dithiaoctane-1,8-diol | 1 gram |
| Water to make up to | 1000 ml |
| Conditioner | |
| Water | 700 ml |
| Sodium sulfite | 12 grams |
| Sodium ethylenediaminetetraacetate dihydrate | 8 grams |
| Thioglycerine | 0.4 ml |
| Water to make up to | 1000 ml |
| Bleach | |
| Water | 800 ml |
| Sodium ethylenediaminetetra-acetate dihydrate | 2 grams |
| Ammonium ethylenediaminetetraacetato ferrate dihydrate | 120 grams |
| Potassium bromide | 100 grams |
| Ammonium nitrate | 10 grams |
| Water to make up to | 1000 ml |
| Fixer | |
| Water | 800 ml |
| Sodium thiosulfate | 80.0 grams |
| Sodium sulfite | 5.0 grams |
| Sodium bisulfite | 5.0 grams |
| Water to make up to | 1000 ml |
| Stabilizer | |
| Water | 800 ml |
| Formaldehyde (37 wt %) | 5.0 ml |
| Polyoxyethylene p-monononylphenyl ether (average degree of polymerization 10) | 0.5 ml |
| Water to make up to | 1000 ml |

Furthermore, processing was carried out with fixer washing water as indicated below and similar results were obtained.

| Water Washing Water | |
|---|---|
| Disodium ethylenediaminetetraacetate | 0.4 grams |
| Water to make up to | 1000 ml |
| pH adjusted with sodium hydroxide | 7.0 |

TABLE 1

| Sample No. | Compound Added to the Seventeenth Layer: Compound | Compound Added to the Seventeenth Layer: Coated Weight* ($mg/m^2$) | Photographic Speed (Immediately after Manufacture): (Blue-Sensitive Layer) | Photographic Speed (Immediately after Manufacture): (Green-Sensitive Layer) | Photographic Speed (Immediately after Manufacture): (Red-Sensitive Layer) | $\Delta D_{1.0}$ (Blue-Sensitive Layer) |
|---|---|---|---|---|---|---|
| 101 (Comparative Example) | — | — | 100 | 100 | 100 | 0.04 |
| 102 (This Invention) | P-3 | 7 | 110 | 100 | 100 | 0.04 |
| 103 (This Invention) | P-3 | 21 | 129 | 105 | 102 | 0.05 |
| 104 (This Invention) | P-4 | 21 | 126 | 102 | 100 | 0.04 |
| 105 (This Invention) | P-10 | 7 | 107 | 100 | 100 | 0.04 |
| 106 (This Invention) | P-10 | 21 | 123 | 102 | 100 | 0.05 |
| 107 (This Invention) | P-15 | 21 | 120 | 100 | 100 | 0.05 |
| 108 (Comparative Example) | AB-1 | 7 | 110 | 110 | 107 | 0.06 |
| 109 (Comparative Example) | AB-1 | 21 | 132 | 126 | 117 | 0.08 |
| 110 | AB-2 | 7 | 107 | 107 | 105 | 0.16 |

TABLE 1-continued

| Sample No. | Compound Added to the Seventeenth Layer: Compound | Compound Added to the Seventeenth Layer: Coated Weight* ($mg/m^2$) | Photographic Speed (Immediately after Manufacture): (Blue-Sensitive Layer) | Photographic Speed (Immediately after Manufacture): (Green-Sensitive Layer) | Photographic Speed (Immediately after Manufacture): (Red-Sensitive Layer) | $\Delta D_{1.0}$ (Blue-Sensitive Layer) |
|---|---|---|---|---|---|---|
| (Comparative Example) | | | | | | |
| 111 (Comparative Example) | AB-2 | 21 | 123 | 117 | 110 | 0.35 |
| 112 (Comparative Example) | AB-3 | 7 | 100 | 100 | 100 | 0.04 |
| 113 (Comparative Example) | AB-3 | 21 | 101 | 100 | 100 | 0.04 |
| 114 (Comparative Example) | AB-4 | 7 | 108 | 102 | 100 | 0.12 |
| 115 (Comparative Example) | AB-4 | 21 | 120 | 104 | 102 | 0.25 |

As is shown in Table 1, with Sample Nos. 102 to 107 to which compounds of this invention had been added to the seventeenth layer (the high speed blue-sensitive emulsion layer) and Comparative Sample Nos. 114 and 115 there was an increase in the speed of only the blue-sensitive layer with virtually no change in the speeds of the green and the red-sensitive layers. Whereas, with Sample Nos. 108 to 110 to which comparative compounds had been added, the green-sensitive layer exhibited an increase in speed of the same order as that of the blue-sensitive layer and there was also an increase in speed approaching that of the blue-sensitive layer in the red-sensitive layer. Furthermore, with Comparative Samples Nos. 112 and 113 there was virtually no speed increasing effect in the blue-sensitive layer. On the basis of these results it is clear that increasing speed by means of the compounds of this invention is a means of increasing speed which is easily controlled.

Moreover, on inspecting the developed Comparative Sample No. 111 with an optical microscope it was observed that there was a tendency towards dye cloud aggregation but no such tendency was observed with Sample Nos. 102 to 107 of this invention.

Furthermore, among the samples of which the speed of only the blue-sensitive layer had been increased, the variation in photographic performance due to ageing was very slight with Sample Nos. 102 to 107 of this invention, whereas changes were observed in the photographic performance of the blue-sensitive layer with Comparative Sample Nos. 114 and 115.

From the above results is clear that this invention provides an effective method for sensitizing a specified layer without affecting other layers and in a manner which is stable with respect of ageing.

EXAMPLE 2

Sample No. 201, a multi-layer color photosensitive material comprising an undercoated cellulose triacetate film support having thereon layers having the compositions indicated below, was prepared.

Composition of the Photosensitive Layer

The coated weights shown are the weight of silver in units of $g/m^2$ in the case of silver halides and colloidal silver, the weight in units of $g/m^2$ in the case of couplers, additives and gelatin, and the number of mol per mol of silver halide in the same layer in the case of the sensitizing dyes.

| | |
|---|---|
| First Layer: Anti-halation Layer | |
| Black colloidal silver | as silver 0.20 |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Second Layer: Intermediate Layer | |
| Fine grain silver bromide (AgI content 1.0 mol %, Corresponding sphere diameter 0.07 μm) | 0.15 as silver |
| Gelatin | 1.00 |
| ExC-4 | $6.0 \times 10^{-2}$ |
| Cpd-3 | $2.0 \times 10^{-2}$ |
| Third Layer: First Red-Sensitive Emulsion Layer | |
| Silver iodobromide emulsion (AgI 5.0 mol %, high surface AgI type, corresponding sphere diameter 0.9 μm, variation coefficient of the corresponding sphere diameter 21%, tabular grains, diameter/thickness ratio 7.5) | 0.42 as silver |
| Silver iodobromide emulsion (AgI 4.0 mol %, high internal AgI type, corresponding sphere diameter 0.4 μm, variation coefficient of the corresponding sphere diameter 18%, tetradecahedral grains) | 0.40 as silver |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ mol |
| ExC-1 | 0.65 |
| ExC-3 | $1.0 \times 10^{-2}$ |
| ExC-4 | $2.3 \times 10^{-2}$ |
| Solv-1 | 0.32 |
| Fourth Layer: Second Red-Sensitive Emulsion Layer | |
| Silver iodobromide emulsion (AgI 8.5 mol %, high internal AgI type, corresponding sphere diameter 1.0 μm, variation coefficient of the corresponding sphere diameter 25%, plate like grains, diameter/thickness ratio 3.0) | 0.85 as silver |
| Gelatin | 0.91 |
| ExS-1 | $3.0 \times 10^{-4}$ mol |
| ExS-2 | $1.0 \times 10^{-4}$ mol |
| ExS-3 | $3.0 \times 10^{-5}$ mol |

-continued

| | |
|---|---|
| ExC-1 | 0.13 |
| ExC-2 | $6.2 \times 10^{-2}$ |
| ExC-4 | $4.0 \times 10^{-2}$ |
| Solv-1 | 0.10 |
| Fifth Layer: Third Red-Sensitive Emulsion Layer | |
| Silver iodobromide emulsion (AgI 11.3 mol %, high internal AgI type, corresponding sphere diameter 1.4 μm, variation coefficient of the corresponding sphere diameter 28%, plate like grains, diameter/thickness ratio 6.0) | 1.50 as silver |
| Gelatin | 1.20 |
| ExS-1 | $2.0 \times 10^{-4}$ mol |
| ExS-2 | $6.0 \times 10^{-5}$ mol |
| ExS-3 | $2.0 \times 10^{-5}$ mol |
| ExC-2 | $8.5 \times 10^{-2}$ |
| ExC-5 | $7.3 \times 10^{-2}$ |
| Solv-1 | 0.12 |
| Solv-2 | 0.12 |
| Sixth Layer: Intermediate Layer | |
| Gelatin | 1.00 |
| Cpd-4 | $8.0 \times 10^{-2}$ |
| Solv-1 | $8.0 \times 10^{-2}$ |
| Seventh Layer: First Green-Sensitive Emulsion Layer | |
| Silver iodobromide emulsion (AgI 5.0 mol %, high surface AgI type, corresponding sphere diameter 0.9 μm, variation coefficient of the corresponding sphere diameter 21%, tabular grains, diameter/thickness ratio 7.0) | 0.28 as silver |
| Silver iodobromide emulsion (AgI 4.0 mol %, high internal AgI type, corresponding sphere diameter 0.4 μm, variation coefficient of the corresponding sphere diameter 18%, tetradecahedral grains) | 0.16 as silver |
| Gelatin | 1.20 |
| ExS-4 | $5.0 \times 10^{-4}$ mol |
| ExS-5 | $2.0 \times 10^{-4}$ mol |
| Exs-6 | $1.0 \times 10^{-4}$ mol |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| Eighth Layer: Second Green-Sensitive Emulsion layer | |
| Silver iodobromide emulsion (AgI 8.5 mol %, high internal AgI type, corresponding sphere diameter 1.0 μm, variation coefficient of the corresponding sphere diameter 25%, plate like grains, diameter/thickness ratio 3.0) | 0.57 as silver |
| Gelatin | 0.45 |
| ExS-4 | $3.5 \times 10^{-4}$ mol |
| ExS-5 | $1.4 \times 10^{-4}$ mol |
| Exs-6 | $7.0 \times 10^{-5}$ mol |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Ninth Layer: Intermediate Layer | |
| Gelatin | 0.50 |
| Solv-1 | $2.0 \times 10^{-2}$ |
| Tenth Layer: Third Green-Sensitive Emulsion Layer | |
| Silver iodobromide emulsion (AgI 11.3 mol %, high internal AgI type, corresponding sphere diameter 1.4 μm, variation coefficient of the corresponding sphere diameter 28%, plate like grains, diameter/thickness ratio 6.0) | 1.30 as silver |
| Gelatin | 1.20 |

-continued

| | |
|---|---|
| ExS-4 | $2.0 \times 10^{-4}$ mol |
| ExS-5 | $8.0 \times 10^{-5}$ mol |
| ExS-6 | $8.0 \times 10^{-5}$ mol |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| Eleventh Layer: Yellow Filter Layer | |
| Gelatin | 0.50 |
| Cpd-6 | $5.2 \times 10^{-2}$ |
| Solv-1 | 0.12 |
| Twelfth Layer: Intermediate Layer | |
| Gelatin | 0.45 |
| Cpd-3 | 0.10 |
| Thirteenth Layer: First Blue-Sensitive Emulsion Layer | |
| Silver iodobromide emulsion (AgI 2 mol %, uniform AgI type, corresponding sphere diameter 0.55 μm, variation coefficient of the corresponding sphere diameter 25%, tabular grains, diameter/thickness ratio 7.0) | 0.20 as silver |
| Gelatin | 1.00 |
| ExS-7 | $3.0 \times 10^{-4}$ mol |
| ExY-1 | 0.60 |
| ExY-2 | $2.3 \times 10^{-2}$ |
| Solv-1 | 0.15 |
| Fourteenth Layer: Second Blue-Sensitive Emulsion Layer | |
| Silver iodobromide emulsion (AgI 19.0 mol %, high internal AgI type, corresponding sphere diameter 1.0 μm, variation coefficient of the corresponding sphere diameter 16%, octahedral grains) | 0.19 as silver |
| Gelatin | 0.35 |
| ExS-7 | $2.0 \times 10^{-4}$ mol |
| ExY-1 | 0.22 |
| Solv-1 | $7.0 \times 10^{-2}$ |
| Fifteenth Layer: Intermediate Layer | |
| Fine grain silver iodobromide (AgI 2 mol %, uniform AgI type, corresponding sphere diameter 0.13 μm) | 0.20 as silver |
| Gelatin | 0.36 |
| Sixteenth Layer: Third Blue-Sensitive Emulsion Layer | |
| Silver iodobromide emulsion (AgI 14.0 mol %, high internal AgI type, corresponding sphere diameter 1.7 μm, variation coefficient of the corresponding sphere diameter 28%, plate like grains, diameter/thickness ratio 5.0) | 1.55 as silver |
| Gelatin | 1.00 |
| ExS-8 | $1.5 \times 10^{-4}$ mol |
| ExY-1 | 0.21 |
| Solv-1 | $7.0 \times 10^{-2}$ |
| Seventeenth Layer: First Protective Layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Eighteenth Layer: Second Protective Layer | |
| Fine grain silver chloride (corresponding sphere diameter 0.07 μm) | 0.36 as silver |
| Gelatin | 0.70 |
| B-1 (diameter 1.5 μm) | $2.0 \times 10^{-2}$ |
| B-2 (diameter 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

The compounds 1,2-benzisothiazolin-3-one (average 200 ppm with respect to the gelatin), n-butyl-p-hydroxybenzoate (1,000 ppm with respect to the gelatin) and 2-phenoxyethanol (10,000 ppm with respect to the gelatin) were added to this sample. Moreover, B-4, B-5, W-2, W-3, F-1, F-2, F-3, F-4, F-5, F-6, F-7, F-7, F-9, F-10, F-11, F-12, F-13, and iron salts, lead salts, gold salts, platinum salts, iridium salts and rhodium salts were also included.

(UV-1)

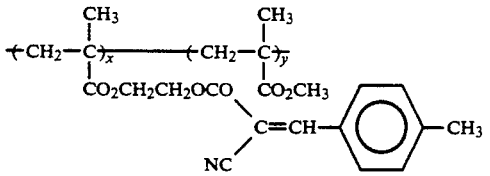

x/y = 7/3 (by weight)
Average Molecular Weight: about 12,000

(UV-2)

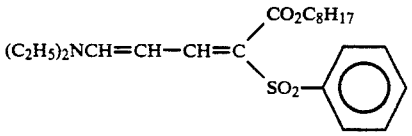

(ExC-1)

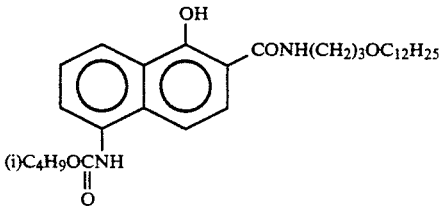

(ExC-2)

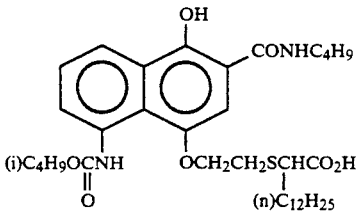

(ExC-3)

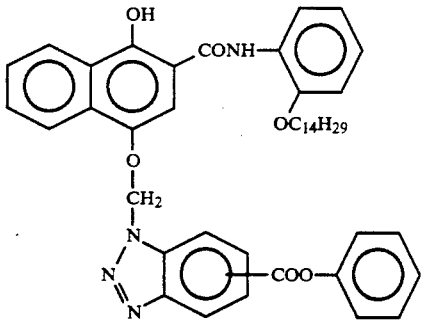

(ExC-4)

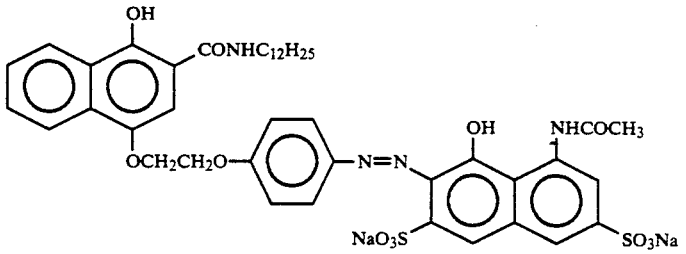

-continued
(ExC-5)
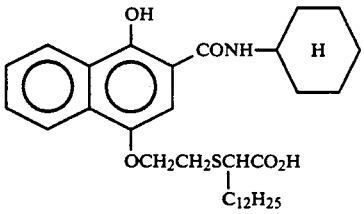
(ExM-1)
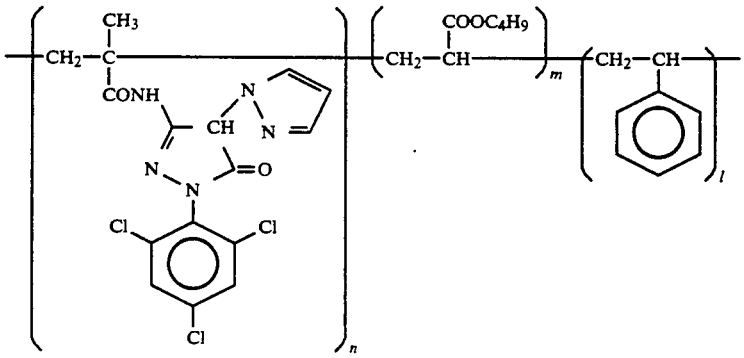
n:m:l = 2:1:1 (by weight)
Average Molecular Weight 20,000
(ExM-2)
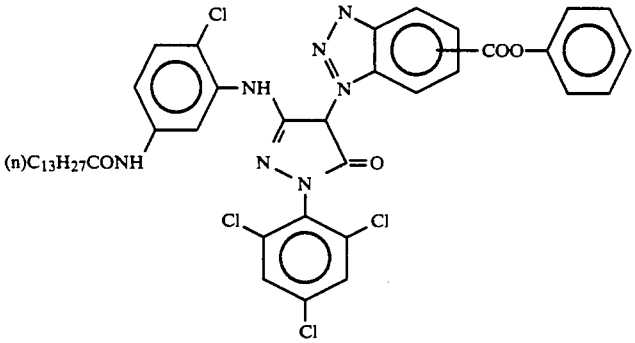
(ExM-3)
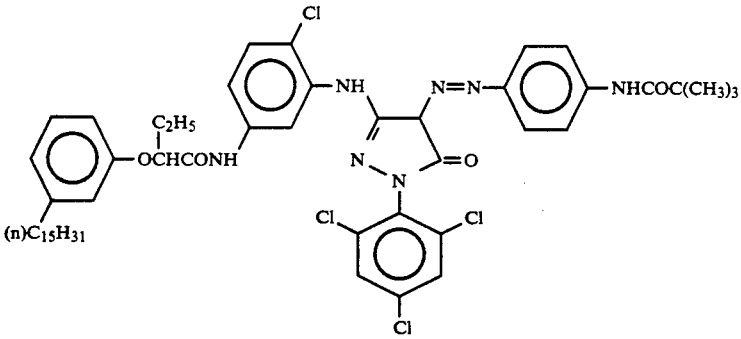
(ExM-4)
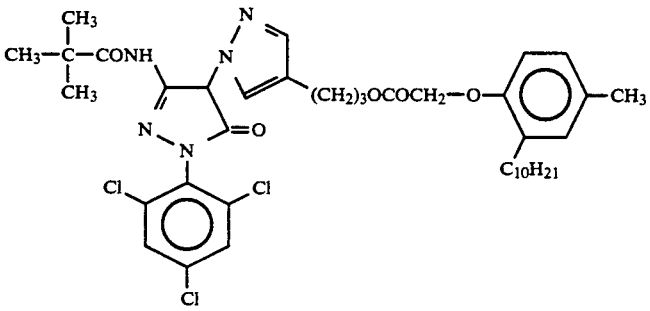

-continued
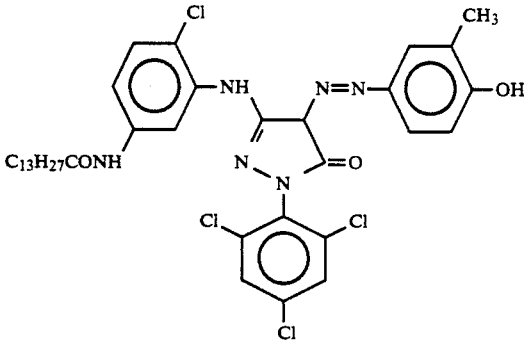
(ExM-5)
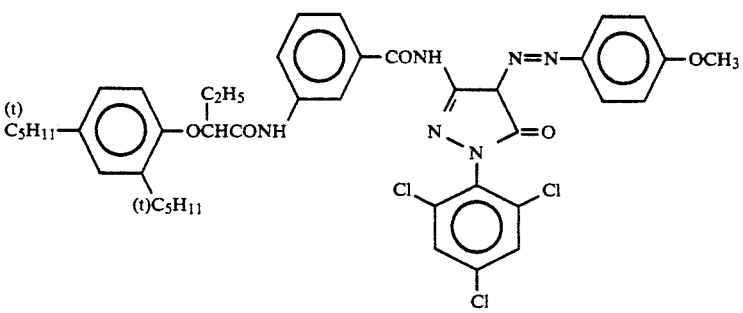
(ExM-6)
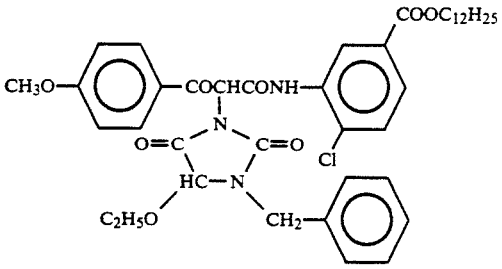
(ExY-1)
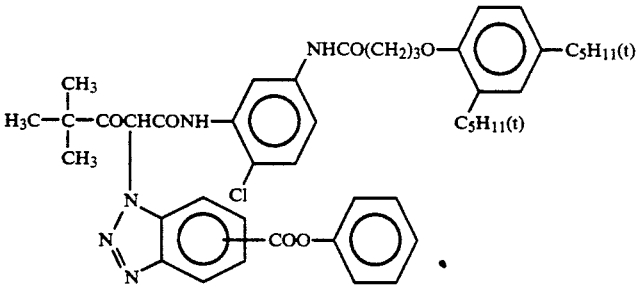
(ExY-2)
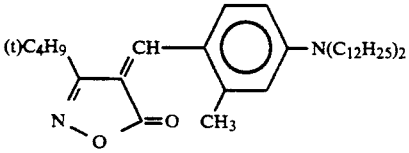
(Cpd-1)

-continued
(Cpd-2)
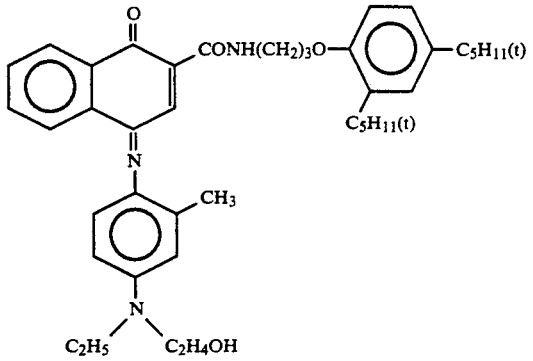
(Cpd-3)
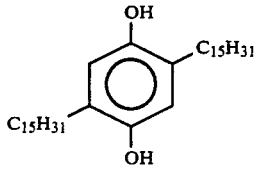
(Cpd-4)
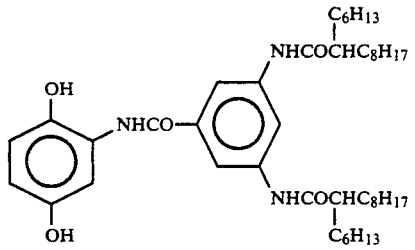
(Cpd-5)
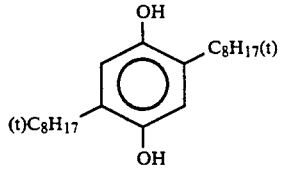
(Cpd-6)
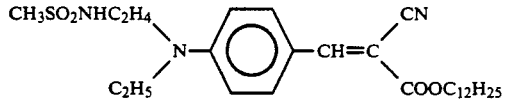
(Cpd-7)
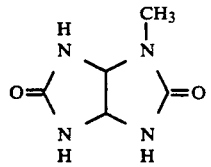
(Solv-1)
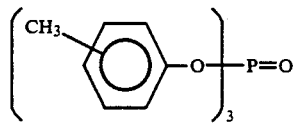
(Solv-2)
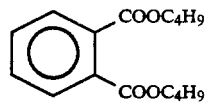

-continued
(Solv-3)
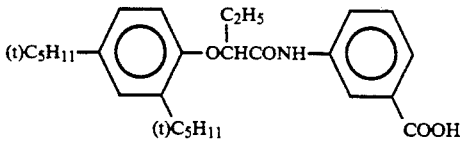
(ExS-1)
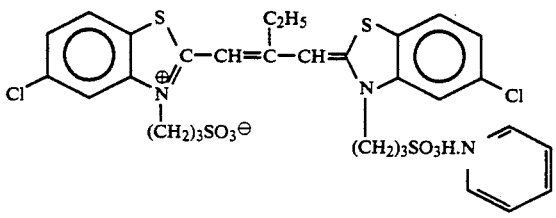
(ExS-2)
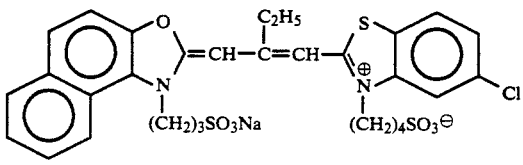
(ExS-3)
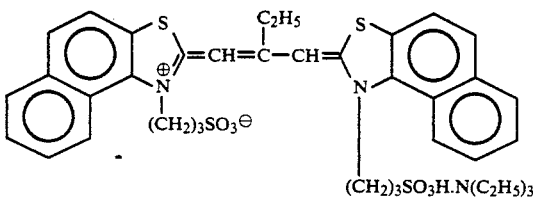
(ExS-4)
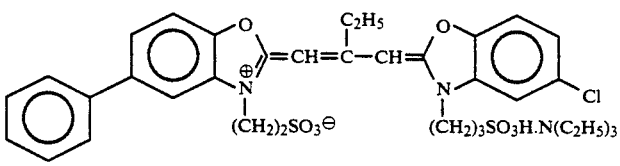
(ExS-5)
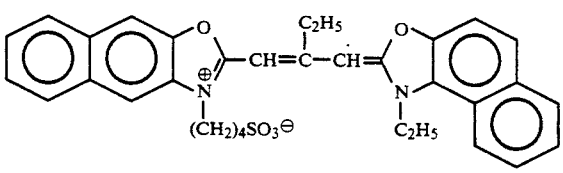
(ExS-6)
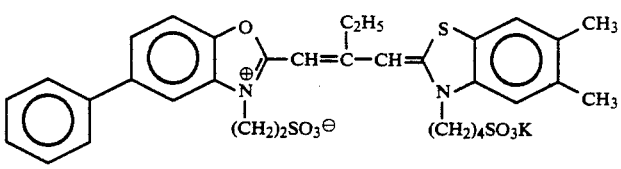
(ExS-7)
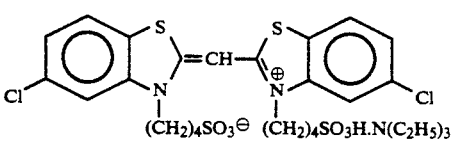
(ExS-8)
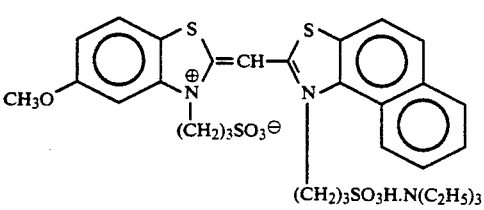

-continued
(B-1)
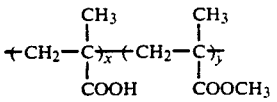
x/y = 10/90
Average Molecular Weight: about 21,000
(B-2)
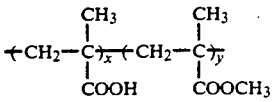
x/y = 40/60
Average Molecular Weight: about 18,000
(B-3)
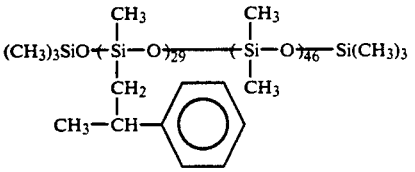
(B-4)
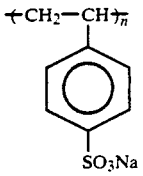
Average Molecular Weight: about 86,000
(B-5)
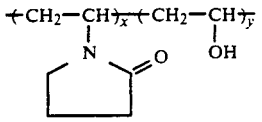
x/y = 70/30
Average Molecular Weight: about 164,000
(W-1)
$C_8F_{17}SO_2NHCH_2CH_2CH_2OCH_2CH_2\overset{\oplus}{N}(CH_3)_3$
(W-1)
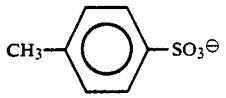
(W-2)
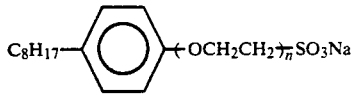
n = 2~4
(W-3)
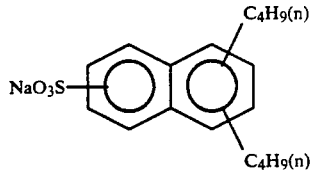
(H-1)
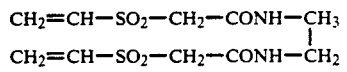
(F-1)
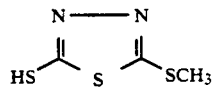

-continued
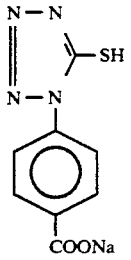
(F-2)
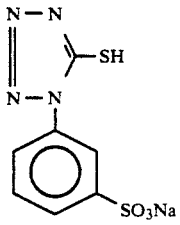
(F-3)
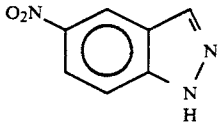
(F-4)
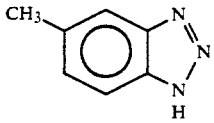
(F-5)
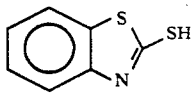
(F-6)
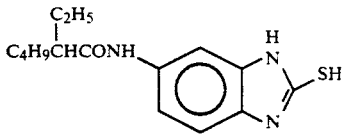
(F-7)
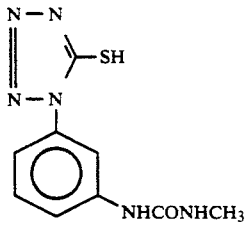
(F-8)
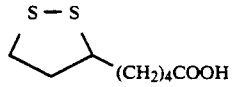
(F-9)
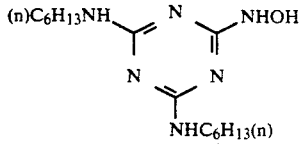
(F-10)

-continued

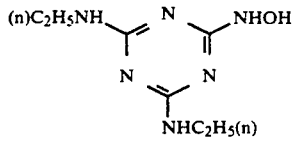

(F-11)

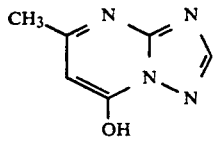

(F-12)

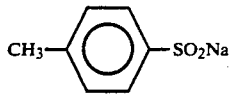

(F-13)

Preparation of Sample Nos. 202 to 207

Sample Nos. 202 to 205 of this invention and Comparative Sample Nos. 206 and 207 were prepared in the same way as Sample No. 201 except that the compounds of this invention and the comparative compounds shown in Table 2 were added to the second layer of Sample No. 201.

Sample Nos. 201 to 207 which had been prepared in this way were subjected to a wedge exposure using white light of color temperature 5500° K. and developed and processed using the processing operations indicated below. After which, density was measured using blue light, green light and red light and then the fog values were obtained and the density differences with an exposure which gave a density of fog +0.5 and an exposure twenty times this exposure were obtained and taken as a measure of gamma (an index of the hardness of gradation). Furthermore, the prepared Sample Nos. 201 to 207 were left to stand for 3 days under forced conditions of 50° C., 80% RH and then their fog values were measured using the same method described above. The difference from the original fog value was obtained and the increase in fog due to ageing (ΔFog) was obtained. The results obtained are shown in Table 2.

Moreover, the coated weight of each compound is shown after calculation as the weight of the polyethylene oxide part within the compound.

| | (Units: Grams) |
|---|---|
| Color Developer | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-Ethyl-N-β-hydroxyethylamino]-2-methylaniline sulfate | 4.5 |
| Water to make up to | 1.0 liter |
| pH | 10.05 |
| Bleach | |
| Sodium ethylenediaminetetraacetato ferrate trihydrate | 100.0 |
| Disodium ethylenediaminetetraacetate | 10.0 |
| Ammonium bromide | 140.0 |
| Ammonium nitrate | 30.0 |
| Aqueous ammonia (27%) | 6.5 ml |
| Water to make up to | 1.0 liter |
| pH | 6.0 |
| Fixer | |
| Disodium ethylenediaminetetraacetate | 0.5 |
| Sodium sulfite | 7.0 |
| Sodium bisulfite | 5.0 |
| Aqueous ammonium thiosulfate solution (70%) | 170.0 ml |
| Water to make up to | 1.0 liter |
| pH | 6.7 |
| Stabilizer | |
| Formaldehyde (37.0%) | 2.0 ml |
| Polyoxyethylene p-monononylphenyl ether (average degree of polymerization 10) | 0.3 |
| Disodium ethylenediaminetetraacetate | 0.05 |
| Water to make up to | 1.0 liter |
| pH | 5.0–8.0 |

The composition of the processing baths were as follows:

| Process | Processing Method: Processing Time | Processing Temp. |
|---|---|---|
| Color development | 3 min. 15 sec. | 38° C. |
| Bleach | 6 min. 30 sec. | 38° C. |
| Water wash | 2 min. 10 sec. | 24° C. |
| Fix | 4 min. 20 sec. | 38° C. |
| Water wash (1) | 1 min. 05 sec. | 24° C. |
| Water wash (2) | 1 min. 00 sec. | 24° C. |
| Stabilization | 1 min. 05 sec. | 38° C. |
| Drying | 4 min. 20 sec. | 55° C. |

TABLE 2

| Sample No. | Compound Added to the Second Layer (Type) | (Amount) (mg/m²) | Photographic Performance: Fog Blue-Sensitive Layer | Fog Green-Sensitive Layer | Fog Red-Sensitive Layer | Gamma Blue-Sensitive Layer | Gamma Green-Sensitive Layer | Gamma Red-Sensitive Layer | ΔFog Blue-Sensitive Layer | ΔFog Green-Sensitive Layer | ΔFog Red-Sensitive Layer |
|---|---|---|---|---|---|---|---|---|---|---|---|
| 201 (Comparative | — | — | 1.00 | 0.70 | 0.30 | 0.90 | 0.80 | 0.65 | 0.01 | 0.01 | 0.01 |

TABLE 2-continued

| Sample No. | Compound Added to the Second Layer (Type) | (Amount) (mg/m²) | Photographic Performance: Fog Blue-Sensitive Layer | Fog Green-Sensitive Layer | Fog Red-Sensitive Layer | Gamma Blue-Sensitive Layer | Gamma Green-Sensitive Layer | Gamma Red-Sensitive Layer | ΔFog Blue-Sensitive Layer | ΔFog Green-Sensitive Layer | ΔFog Red-Sensitive Layer |
|---|---|---|---|---|---|---|---|---|---|---|---|
| Example) | | | | | | | | | | | |
| 202 (This Invention) | P-3 | 30 | 1.00 | 0.70 | 0.32 | 0.90 | 0.80 | 0.80 | 0.01 | 0.01 | 0.01 |
| 203 (This Invention) | P-4 | 30 | 0.98 | 0.70 | 0.33 | 0.88 | 0.80 | 0.82 | 0.01 | 0 | 0.00 |
| 204 (This Invention) | P-10 | 30 | 1.00 | 0.71 | 0.33 | 0.90 | 0.79 | 0.81 | 0.02 | 0.01 | 0.01 |
| 205 (This Invention) | P-15 | 30 | 0.99 | 0.70 | 0.33 | 0.88 | 0.81 | 0.79 | 0.01 | 0.01 | 0.01 |
| 206 (Comparative Example) | AB-1* | 30 | 1.10 | 0.85 | 0.40 | 0.85 | 0.73 | 0.79 | 0.04 | 0.03 | 0.10 |
| 207 (Comparative Example) | AB-4* | 30 | 1.03 | 0.73 | 0.35 | 0.88 | 0.79 | 0.80 | 0.07 | 0.12 | 0.20 |

*The same Comparative Compounds AB-1 and AB-4 as used in Example 1

As shown in Table 2, with Sample Nos. 202 to 205 to which compounds of this invention had been added and Comparative Sample No. 207, the gamma value of the red-sensitive layer which was adjacent to the second layer was increased. In other words, there was a hardening of contrast, with virtually no effect on the photographic performance of the blue and green-sensitive layers. While with Sample No. 206 in which a comparative compound had been added to the second layer, there was a contrast hardening effect in the red-sensitive layer which was adjacent to the second layer but at the same time there was a marked increase in the fog level of the blue and green-sensitive layers (and the increase in fog level of the red-sensitive layer was also larger than that observed with the compounds of this invention), and the gamma values of the blue and green-sensitive layers were lower than those observed with Sample No. 201.

Moreover, among Sample Nos. 202 to 205 and 207 with which a contrast hardening effect was observed in the red-sensitive layer, there was virtually no change in the fog level on ageing with Sample Nos. 202 to 205 of this invention but fog developed with ageing in the case of Comparative Sample No. 207.

It is clear from the results indicated above that this invention is an effective method for hardening the contrast of a specified layer in a stable manner with respect to ageing without affecting the other layers.

While the invention has been described in detail and with reference to specific embodiments thereof, it will be apparent to one skilled in the art that various changes and modifications can be made therein without departing from the spirit and scope thereof.

What is claimed is:

1. A silver halide photographic photosensitive material comprising a support having thereon at least one silver halide photosensitive emulsion layer, wherein a polymer in the form of fine particles which can be represented by the following general formula (I) is included in a silver halide emulsion layer, a protective layer, a filter layer or an intermediate layer of said photographic photosensitive material in an amount calculated as polyethylene oxide of 0.1 to 100 mg/m²:

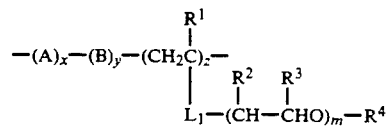

(I)

wherein A represents a repeating unit obtained by polymerizing a monomer which has at least two polymerizable ethylenically unsaturated groups of which at least one is in a side chain; B represents a repeating monomer unit obtained by the polymerization of a monomer which has one polymerizable ethylenically unsaturated group; $R^1$ represents a hydrogen atom or an alkyl group; $R^2$ and $R^3$ each represents a hydrogen atom or a methyl group; $R^4$ represents a hydrogen atom or an organic group; $L_1$ represents a divalent group comprising at least three atoms by which the main macromolecular chain and the poly(ethylene oxide) unit are linked; m represents an integer of at least 10, and x, y and z indicate percentages by weight wherein x is from 5 to 25, y is from 10 to 80 and z is from 15 to 85, based on the total weight of the polymer.

2. A silver halide photographic photosensitive material as in claim 1, wherein x is a percentage from 10 to 20, y is a percentage from 30 to 70, and z is a percentage from 20 to 50.

3. A silver halide photographic photosensitive material as in claim 1, wherein $L_1$ represents a group represented by general formula (II):

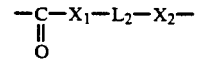

(II)

wherein $X_1$ represents an oxygen atom or

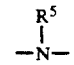

(wherein $R^5$ is a hydrogen atom, an alkyl group, an aryl group or an acyl group; $L_2$ is an alkylene group which has at least 2 but not more than 20 carbon atoms in its main chain, or an arylene group which has at least 6 carbon atoms; $X_2$ represents an oxygen atom, $$-\underset{\underset{O}{\|}}{C}-O-,\ -O-\underset{\underset{O}{\|}}{C}-,\ -\underset{\underset{O}{\|}}{C}-X_1-,\ -X_1-\underset{\underset{O}{\|}}{C}-,$$

-continued $$-X_1-\underset{\underset{O}{\|}}{C}-X_1,\ -X_1-\underset{\underset{O}{\|}}{C}-O-,\ -O-\underset{\underset{O}{\|}}{C}-X_1-\ \text{or}\ -\overset{\overset{R^5}{|}}{N}-$$

(wherein $X_1$ and $R^5$ have the same meaning as described earlier).

* * * * *